US006101697A

United States Patent [19]

Stumpf et al.

[11] Patent Number: 6,101,697

[45] Date of Patent: Aug. 15, 2000

[54] APPARATUS FOR PRODUCING STRING OF POCKET COILS

[75] Inventors: Walter Stumpf, Dunwoody; W. Kenneth McLaren, Conyers, both of Ga.

[73] Assignee: International Bedding Corporation, Inc., Ft. Lauderdale, Fla.

[21] Appl. No.: 08/927,051

[22] Filed: Sep. 10, 1997

[51] Int. Cl.[7] ..... B68G 7/00

[52] U.S. Cl. ..... 29/91; 29/771; 29/822; 53/114

[58] Field of Search ..... 29/91, 91.1, 771, 29/789, 797, 822; 53/114

[56] References Cited

U.S. PATENT DOCUMENTS

| | | | |
|---|---|---|---|
| 1,861,429 | 5/1932 | Schneider et al. | 53/114 |
| 3,668,816 | 6/1972 | Thompson | 29/91.1 X |
| 4,389,743 | 6/1983 | Callaway . | |
| 5,537,699 | 7/1996 | Bonaddio et al. . | |
| 5,613,287 | 3/1997 | St. Clair | 29/91.1 |

*Primary Examiner*—Joseph M. Gorski
*Attorney, Agent, or Firm*—Wood, Herron & Evans, L.L.P.

[57] ABSTRACT

The apparatus takes coil springs and sequentially forms fabric pockets around the coil springs to form a string of pocket coil springs. It includes a system for forming a length of folded fabric for movement on a frame, a split cylinder which moves to an inclined position to receive a coil spring and then to a generally vertical position to locate the coil spring on a support member and to allow a compressing member to extend through the gap of the split cylinder to compress the coil spring. An inserting device is employed to insert the compressed coil spring between the folded layers of the length of folded fabric which then is moved on the frame to bonding units to allow an edge bond and transverse bonds to be made to form a pocket around each coil spring. The bonding units includes of two stationary ultrasonic bonding devices fixedly located below the length of folded fabric with movable anvils located above the length of folded fabric which are employed for carrying out the bonding operations.

34 Claims, 15 Drawing Sheets

APPARATUS FOR PRODUCING STRING OF POCKET COILS

BACKGROUND OF THE INVENTION

1. Field of the Invention

The invention relates to a system for producing a string of pocket coil springs for mattresses.

2. Description of the Prior Art

U.S. Pat. Nos. 5,537,699 and 4,389,743 disclose strings of pocket coil springs used for mattresses.

SUMMARY OF THE INVENTION

It is an object of the invention to provide a unique apparatus for rapidly forming a string of pocket coil springs for forming mattresses, cushions, etc.

The apparatus takes coil springs and sequentially forms pockets around the coil springs to form a string of pocket coil springs. In the preferred embodiment, the apparatus comprises a fabric feed system for forming a length of folded material for movement on a frame, a split cylinder which moves to an inclined position to receive a coil spring and then to a an upright position to locate the coil spring on a support means to allow a compressing means to extend through the gap of the split cylinder to compress the coil spring. An inserting device is employed to insert the compressed coil spring between the folded layers of the length of folded material which then is moved on the frame to two spaced apart bonding means to allow an edge bond and transverse bonds to be made to form a pocket around each coil spring. The bonding means includes of two ultrasonic bonding means fixedly located below the length of folded fabric with movable anvils located above the length of folded material which are employed for carrying out the bonding operations.

A system is employed at the front of the frame to sense the tension of the fabric being fed onto the frame. If the tension becomes too low, the feeding of the fabric onto the frame is terminated. If the tension of the fabric becomes too high, operation of the apparatus is shut down.

DESCRIPTION OF THE PREFERRED EMBODIMENT

Figure 2:
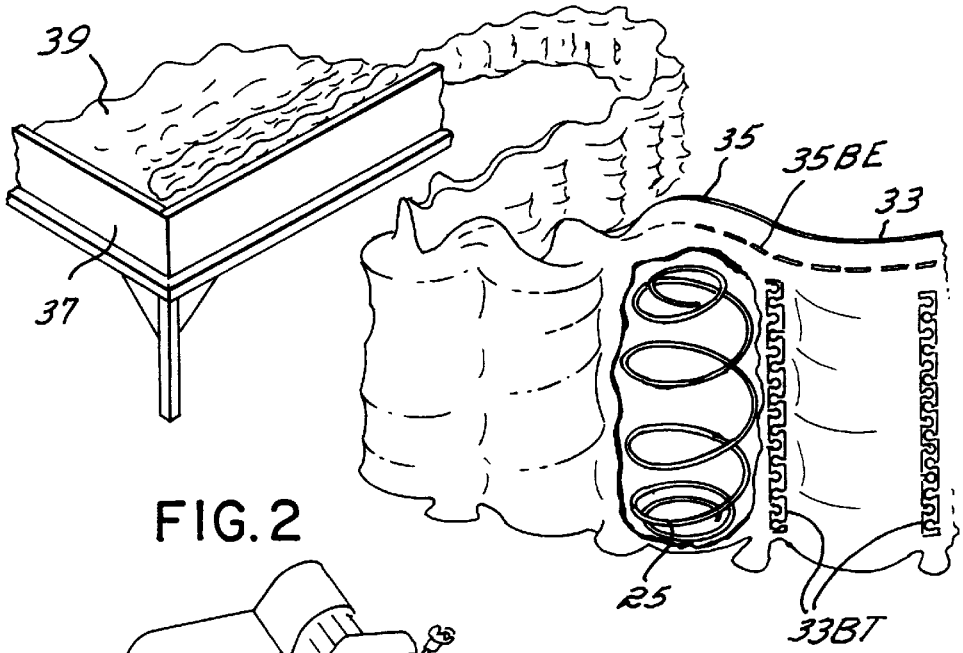
FIG. 2 illustrates a string of pocket coil springs produced by the invention.
Figure 1:
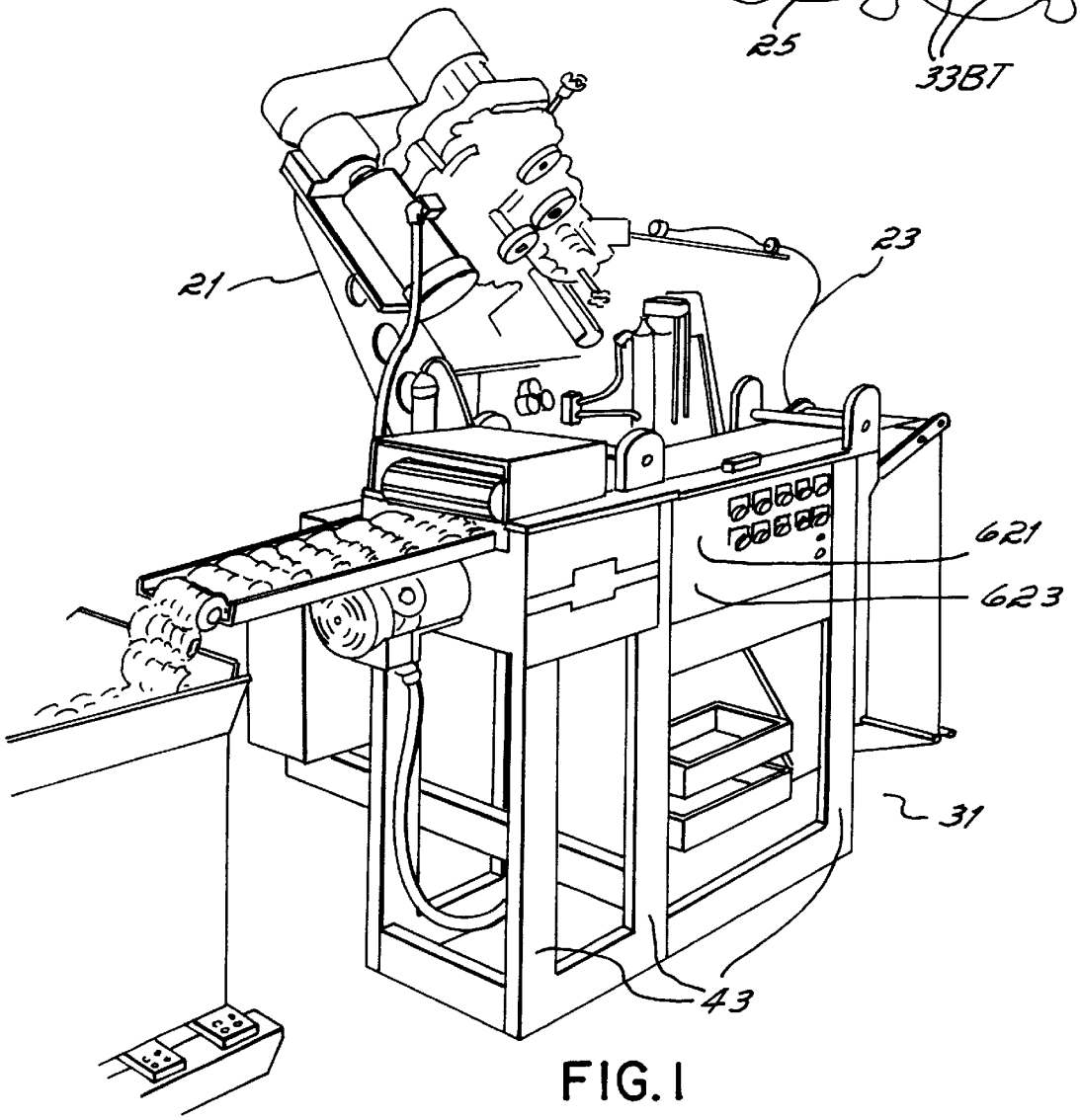
FIG. 1 an isometric view of the apparatus of the invention located next to a coil spring producing machine.
Figure 3:
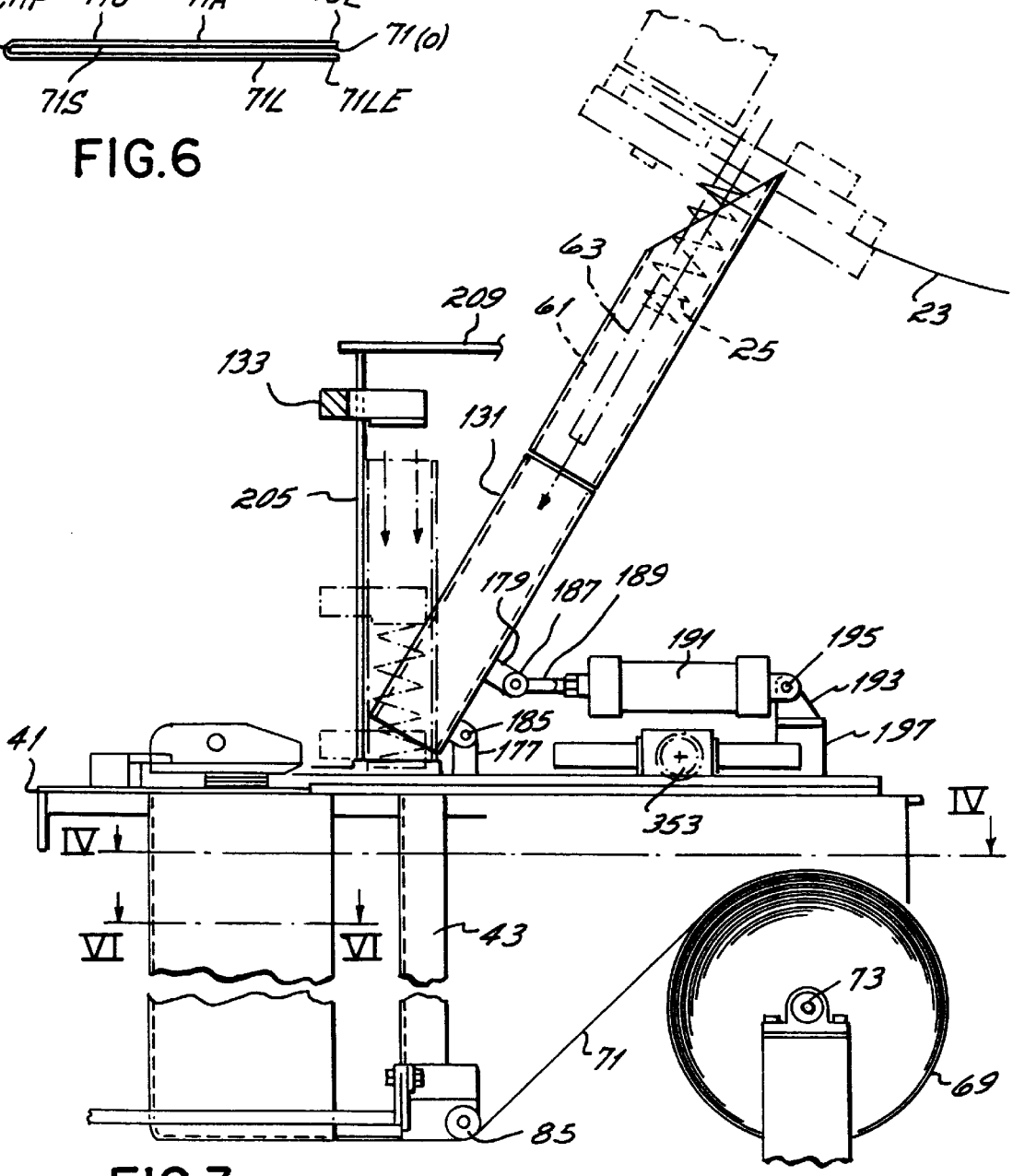
FIG. 3 illustrates a side view of the apparatus of the invention showing a roll of fabric and a mechanism for providing a length of folded fabric on the frame.
Figure 5:
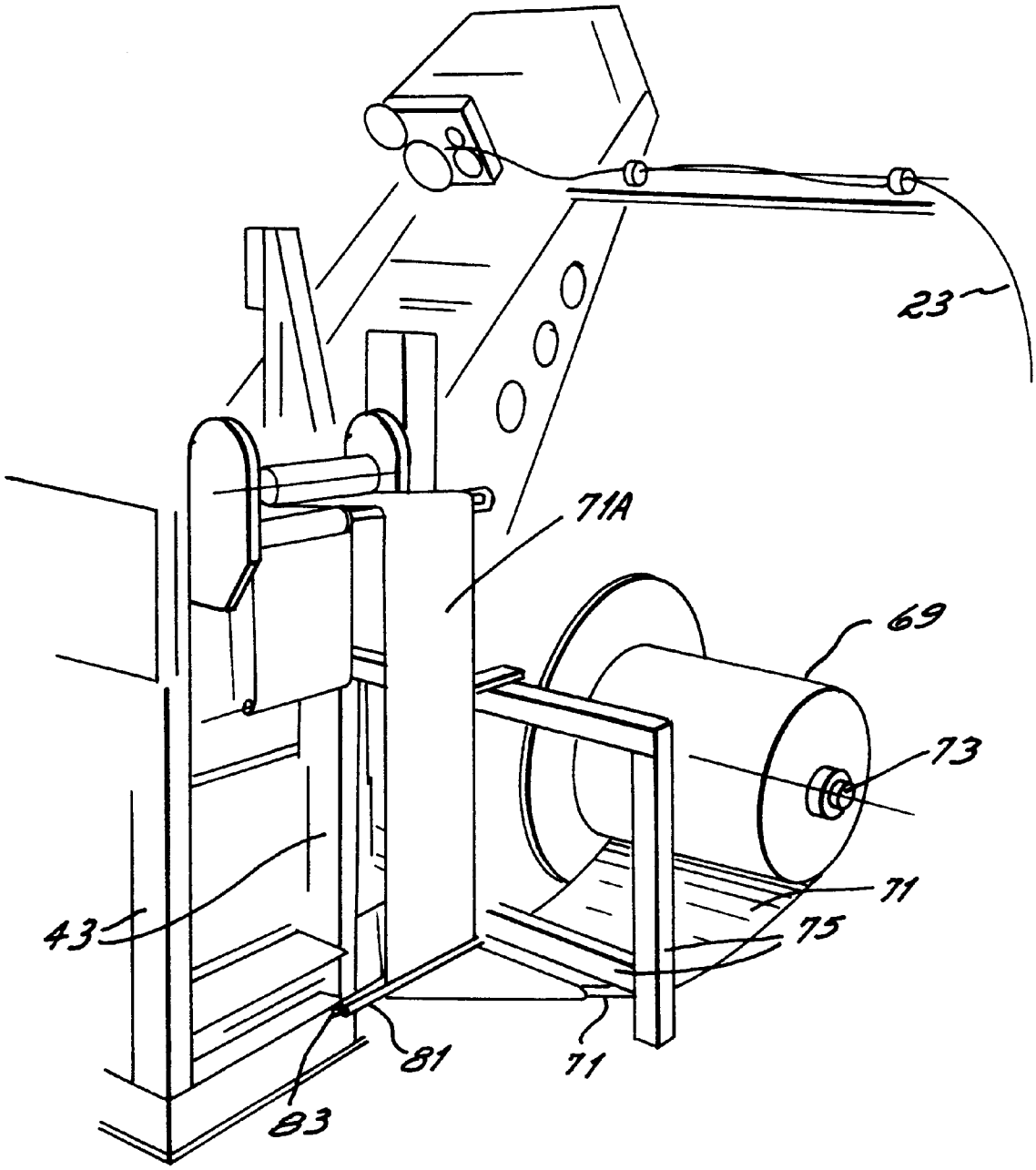
FIG. 5 is an isometric view of the fabric support and folding mechanism.

Referring now to FIG. 1, there is illustrated a conventional coil spring producing machine 21 for taking a length of metal wire 23 as shown in FIGS. 3 and 5 and forming coil springs 25 as shown in FIG. 2. The coil springs 25 are employed for forming mattresses. The machine 21 periodically produces coil springs of the type identified by reference numeral 25. The machine 21 may be any suitable automatic spring forming mechanism which is in commercial use today This machine has been modified by providing a chute or channel 61 with a central rod 63 as shown in FIG. 3 for periodically receiving the coiled springs 25 from the machine 21.

Referring to FIGS. 1 and 2, reference number 31 identifies the apparatus of the invention which takes the coil springs 25 and sequentially forms fabric pockets 33 around the coil springs to form a string 35 of pocket coil springs. The string 35 of pocket coils is folded back and forth in a form 37 for producing a mattress. In forming the mattress, top and bottom cloth sheets (not shown) are bonded or glued to the top 39 and bottom (not shown) sides of the folded string 35 to form the mattress.

Figure 7:
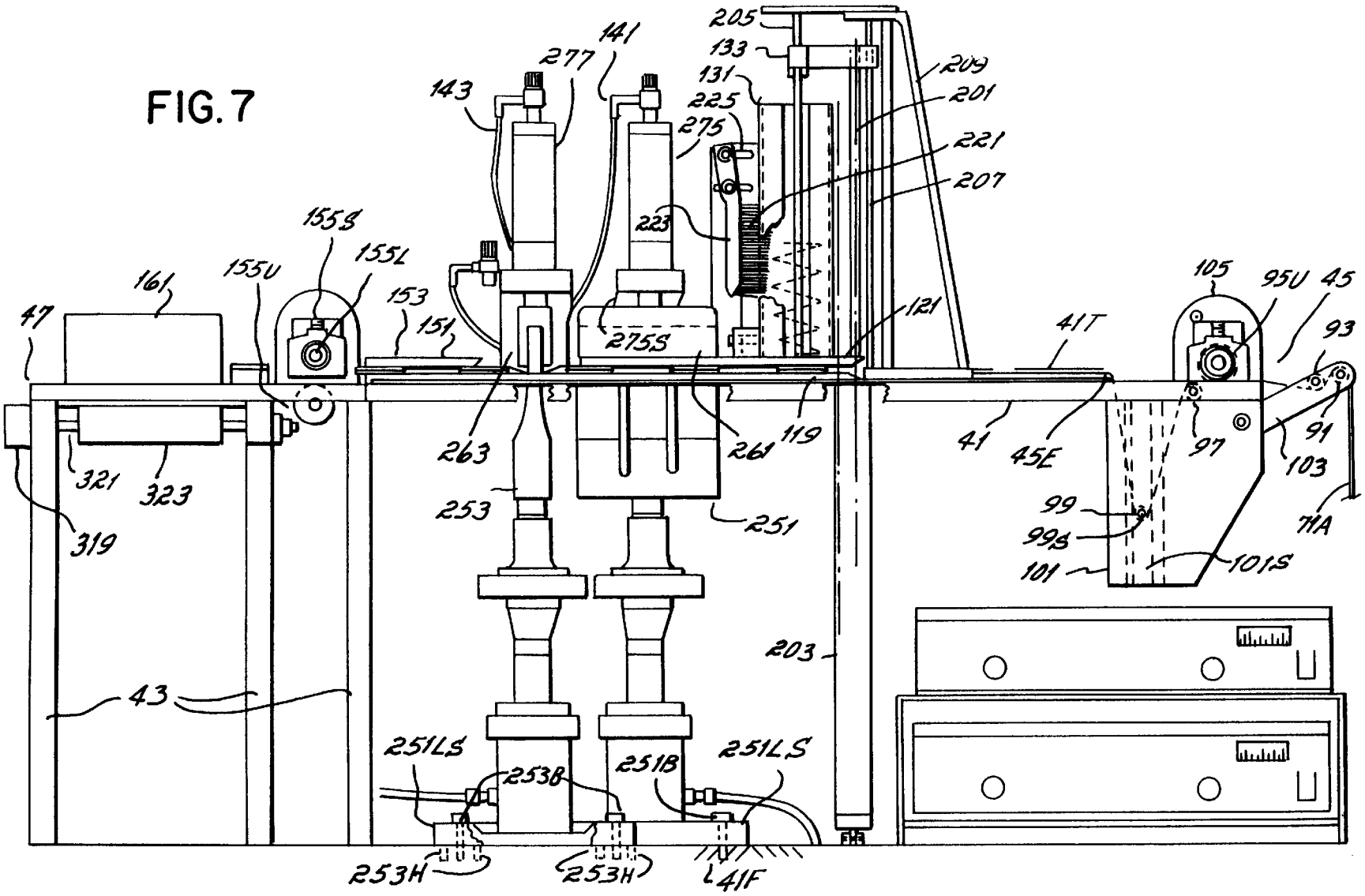
FIG. 7 is a front plan view of the apparatus of the invention.
Figure 8:
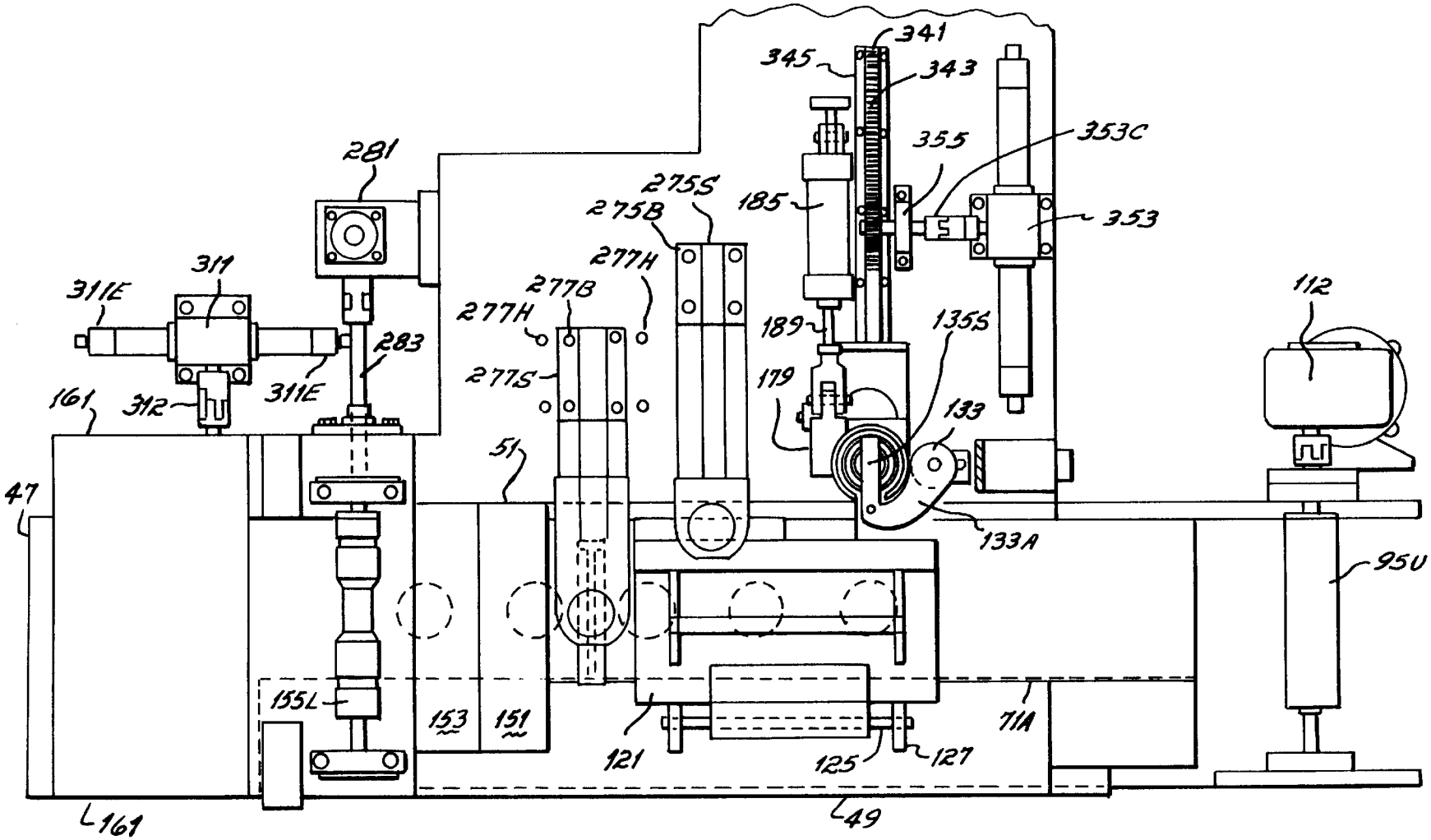
FIG. 8 is a top plan view of the apparatus of the invention.
Figure 11:
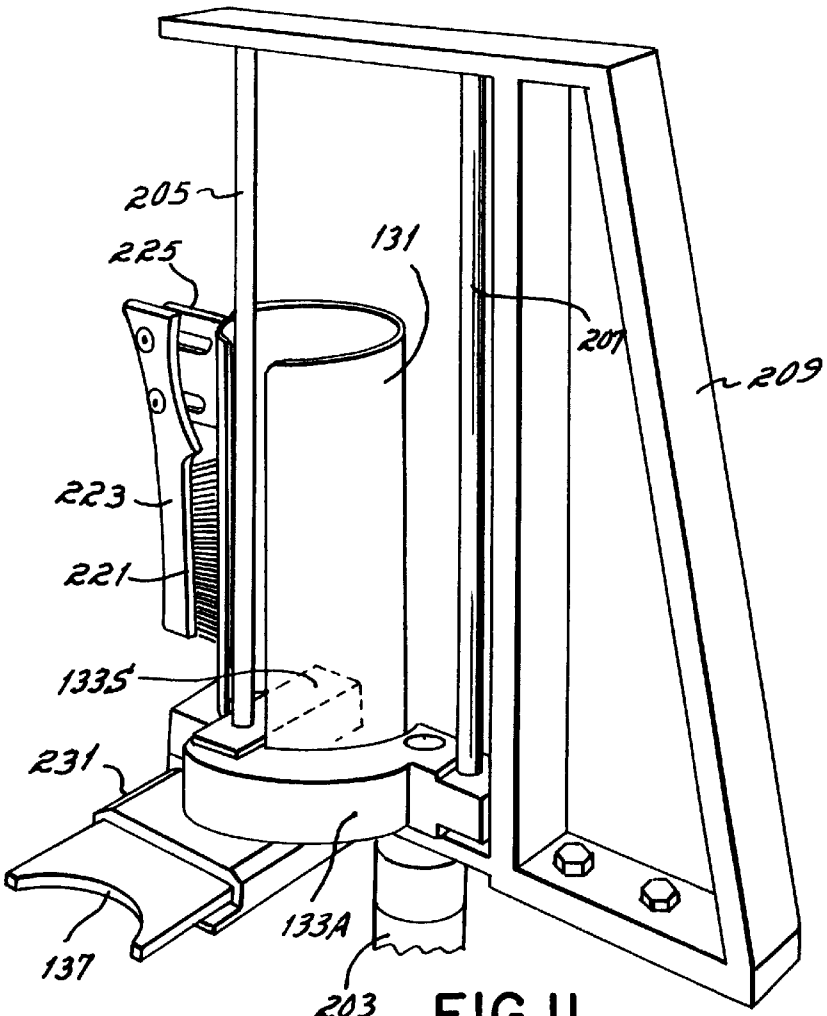
FIG. 11 illustrates the mechanism for compressing a coil spring and for moving a compressed spring outward for insertion between the lower and upper layers of a length of folded fabric on the frame.

Referring to FIGS. 3, 7, and 8, the machine base of the apparatus 31 comprises a frame 41 supported by legs 43. The frame 41 has ends 45 and 47 and edges 49 and 51. The edge 51 is located next to the coil spring producing machine 21. The machine 21 produces the coils 25 and discharges the coils 25 toward the frame 41 by way of the inclined chute or guide 61 with the rod 63 located therein to guide the coil springs 25 within the chute. The guide 61 has an open side facing the frame 41. The guide 61 connected to the coil forming machine 21 by way of a plate 61P.

Figure 6:
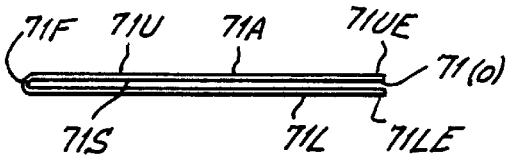
FIG. 6 is a cross-sectional view of a length of folded fabric as seen long line 6—6 of FIG. 3.
Figure 4:
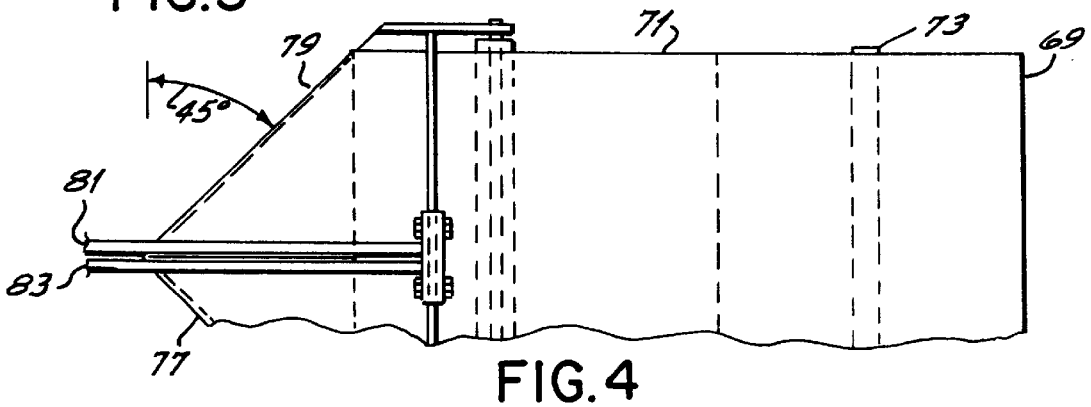
FIG. 4 is a top plan view of the fabric folding mechanism of the invention as seen along the lines 4—4 of FIG. 3.

Referring to FIGS. 3, 4, and 5, located at a level below the frame 41 near the end 45, is a roll 69 of non-woven fabric 71 supported by a spindle 73 attached to the leg structure of the frame 41. Structure 75 connected to the leg structure of the frame 41 supports rods 77 and 79 which are located 45° relative to the axis of the spindle 73 and 90° relative to each other, and two parallel rods 81 and 83 which are perpendicular to the axis of the spindle 73 and parallel to the frame end 45. The rods 77 and 79 each forms an angle 45° relative to the two rods 81 and 83. The fabric 71 is drawn out from the roll 69 and partially around a roller 85, under, partially around and above rods 77 and 79, between the rods 81 and 83 and upward as a folded length of fabric 71A as shown in FIG. 5. The rods 77, 79, 81 and 83 are employed to fold the continuous length of fabric 71 such that on the frame 41, the folded length of fabric 71A has lower and upper layers 71L and 71U with a folded edge 71F located near the edge 49 of the frame 41 and two adjacent edges 71EL and 71EU which are located next to the edge 51 of the frame 41. The two edges 71LE and 71UE of the folded sheet 71A provide an access opening 71(O) to the space 71S between the two layers 71L and 71U. See FIG.6.

The roll 69 can be supported by the spindle 73 to feed fabric from its upper side as shown in FIG. 3 or from its lower side as shown in FIG. 5.

Figure 20:
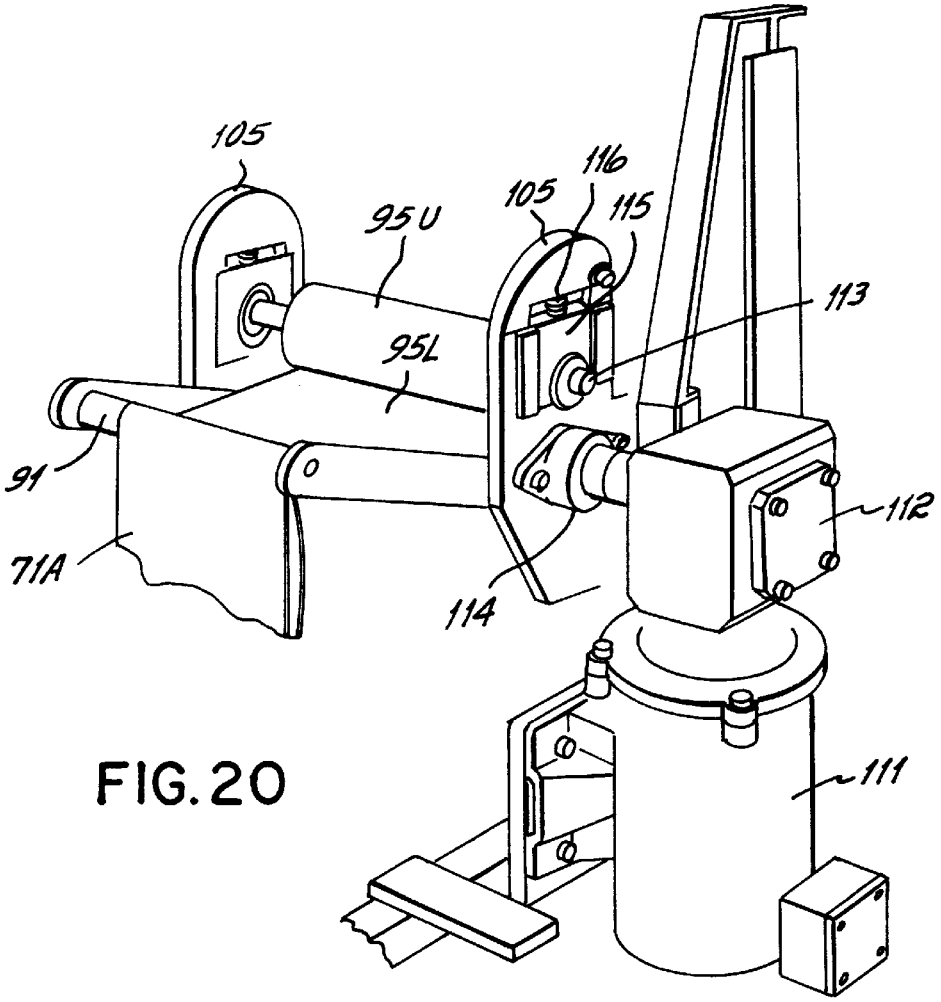
FIG. 20 is an isometric view of the front feed roller mechanism.

Referring to FIGS. 7, 8, and 20 the folded length of fabric 71A extends partially around rollers 91 and 93, between rollers 95U and 95L and partially around roller 97, partially around roller 99 and upward to the edge 45E and then along the top surface 41T of the frame 41. The rollers 91, 93, 95, 97, and 99 are supported by side arms 103 and side members 105, the latter of which are coupled to the outer sides of the top of the frame 41.

Referring to FIG. 20, the shaft of roller 95L is driven by an electric motor 111, gear 112, and coupling member 114 to cause the rollers 95L and 95U to move or feed the folded sheet 71A from the roll 69 on to the frame 41. The shaft 113 of roller 95U is supported in blocks 115 which have their upper ends engaged by springs 116 which in turn are supported by side members 105, coupled to the frame 41. The roller 99 in effect is a floating roller having a shaft 99S which can move upward and downward in two slots 101S formed in support arms 101 coupled to side members 105. (See FIG. 7) The roller 99 is employed to sense the tension of the folded sheet 71A. If the tension becomes too great, the machine is shut down. If the tension becomes too low the fabric feed motor 111 is shut down. The sensing mechanism comprises upper and lower switches activated by the shaft 99S of roller 99 as will be described subsequently.

The folded length of fabric 71A travels above a plate 119 and under a transparent plate 121 which has an edge secured to member 123 which is pivotally secured by a rod 125, to brackets 127 which are in turn secured to the top 41T of the frame 41 near its edge 49. See FIG. 14. Member 121H is a handle connected to two members 121M which are connected to the top of plate 121. The plate 121 can be pivoted out of the way for inspection purposes etc. by the operator if desired. As will be described subsequently a hold down system is employed to hold the plate 121 at a level sufficient to maintain the folded fabric 71A generally flat while the fabric 71A is being fed on the frame 41. The hold down system allows the plate 121 to be pivoted out of the way when desired. In FIG. 7, the members 121,123, 125, and 127 are not shown for purposes of clarity.

Referring to FIGS. 3, 7–11, and 15–18, located next to the edge 51 of the frame are a split cylinder 131 with a spring compression member 133, a support plate 135 and a pusher plate 137 for receiving a coil spring 25 from the guide 61, placing the coil spring 25 on the plate 135 in the proper position; compressing the coil spring on the plate 135; and pushing the compressed coil spring into the space between the lower and upper layers of the folded length of fabric 71A. Downstream of the apparatus 131, 133, 135, and 137 are two bonding units 141 and 143 for forming a continuous edge bond 33BE for bonding the folded sheet edges 71UE and 71LE together and for forming transverse bonds 33BT between the layers 71L and 71U on opposite sides of the coil springs and transverse to the bond 33BE to secure the coil spring 25 within the pockets 33 as shown in FIG. 2. As the length of fabric moves further to the left as shown in FIG. 7, it passes under two transparent plates 151 and 153 with the coil springs 25 still in a compressed state, between an upper roller 155U and a lower driven roller 155L which causes the formed pockets 33 and hence the sheet 71A to move to the left (as shown in FIGS. 7, and 8) and through units 161 and 323 which causes the compressed coil springs 25 in the pockets 33 to return to an uncompressed preloaded state and turns the coil springs in a desired position in their pockets 33, and moves the folded fabric 71A with the expanded coils from the rollers 155U and 155L.

Referring to FIGS. 7–11, and 15, the split cylinder or sleeve 131, is a hollow cylindrical shaped member having lower and upper open ends 171 and 173 and a gap 175 formed in its cylindrical wall between ends 171 and 173. It is supported for pivotal movement between an inclined position in line with the axis of the guide 61 and an upright position over support plate 135. Support is by way of a member 177 connected to the frame 41, member 178 fixedly connected to the lower rear end of the split cylinder 131 and pivotally connected to member 177 by a pin 185 and member 179 fixedly connected to the lower end of the split cylinder 131 and pivotally connected to a piston 189 of a pneumatic cylinder 191 by a pin 187. The opposite end of the cylinder 191 is pivotally coupled to member 193 by a pin 195. Member 193 is connected to the frame 41.

When the piston 189 of the split cylinder 131 is in the retracted position as shown in FIG. 3, the cylinder 131 is in line with the guide 61 for receiving a spring 25 in the chute. The spring then passes through the split cylinder 131 into the opening 136 of a member 199 at a 45 degree position (See FIG. 9). When the piston 189 is extended, the cylinder 131 is moved to an upright position to cause the coil spring 25 to move to an upright position on a support surface 135 partially surrounded by the semi-circular pusher 137.

Figure 9:
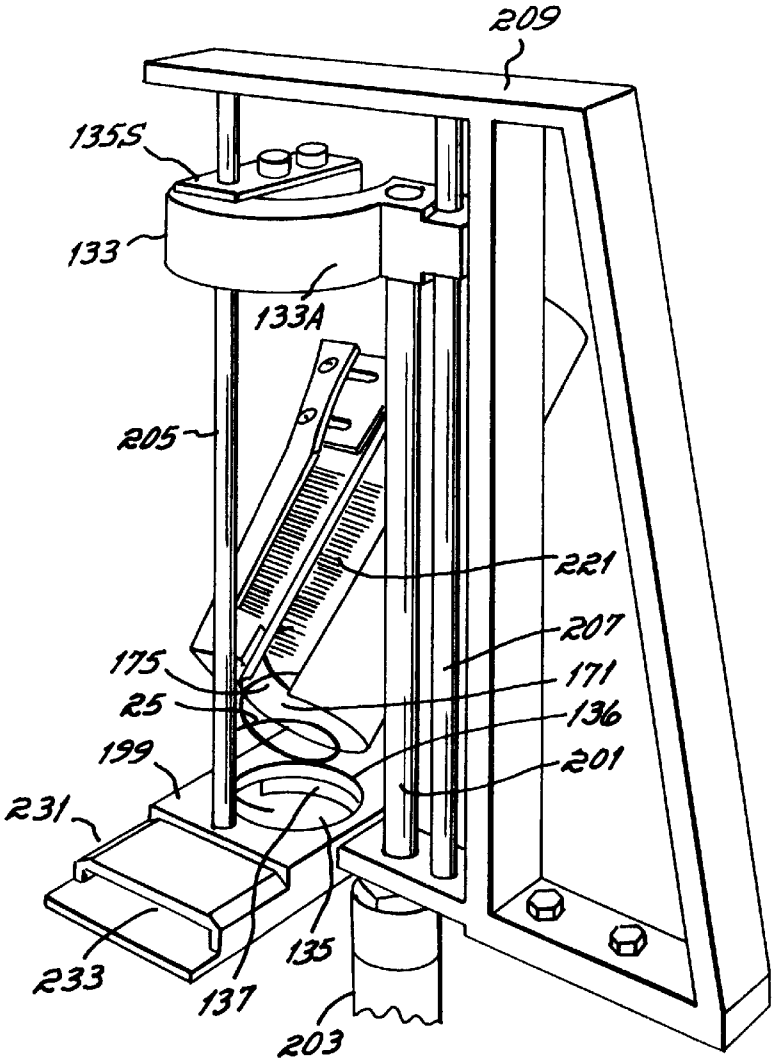
FIGS. 9 and 10, show the sequence of the split cylinder of the apparatus in an inclined position to receive a coil spring and in an upright position to locate a received coil spring against a support surface for allowing the coil spring to be compressed.

The spring compression member 133 has a coil spring engaging portion 133S slidable in the gap 175 of the split cylinder 131 and an a curved portion 133A which is fixedly coupled to a piston 201 which is operated by a lower pneumatic cylinder 203 coupled to the support structure of the frame 41 as shown in FIG. 7. See also FIGS. 9–11. Rods 205 and 207 are guide rods which slidably fit in corresponding holes formed in member 133. The upper ends of the rods 205 and 207 are held fixed in place by structure 209 which is fixedly connected to the frame 41. The guide 205 also limits forward movement of a coil spring when it moves down the inclined cylinder 131 as shown in FIG. 9.

The coil spring engaging portion 133S is located relative to the gap 175 such that it will pass into and out of the gap 175 as the cylinder 131 is moved between the inclined and upright positions. When the cylinder 131 is in an upright position and the piston 201 is retracted by the cylinder 203, it moves the compression portion 133S down in the cylinder 131 and compresses the spring 25 against the surface 135. The pusher 137 then pushes the compressed coil spring 23 from the surface 135 to insert the compressed coil spring 25 into the space between the lower and upper layers 71L and 71H of the folded sheet 71A. While this is occurring, the cylinder 191 retracts the piston to move the split cylinder 131 in line with the guide 61 to receive another coil spring and the cylinder 203 extends its piston 201 to move member 133 to an upward position and the process is repeated after the folded sheet 71A is moved downstream an amount equal to a given distance depending on the desired coil diameter. Supported in the split cylinder 131 are bristles 221 from a bristle device 223 to engage a coil spring 25 as it moves downward in the cylinder 131 to prevent the coil spring from reversing its direction due to spring action when it engages the support plate 135. The wall of the split cylinder 131 has a slot (not shown) formed therethrough for receiving the bristles 221 of the device 223 which is connected to the outside of the cylinder 131 by way of a member 225.

Figure 16:
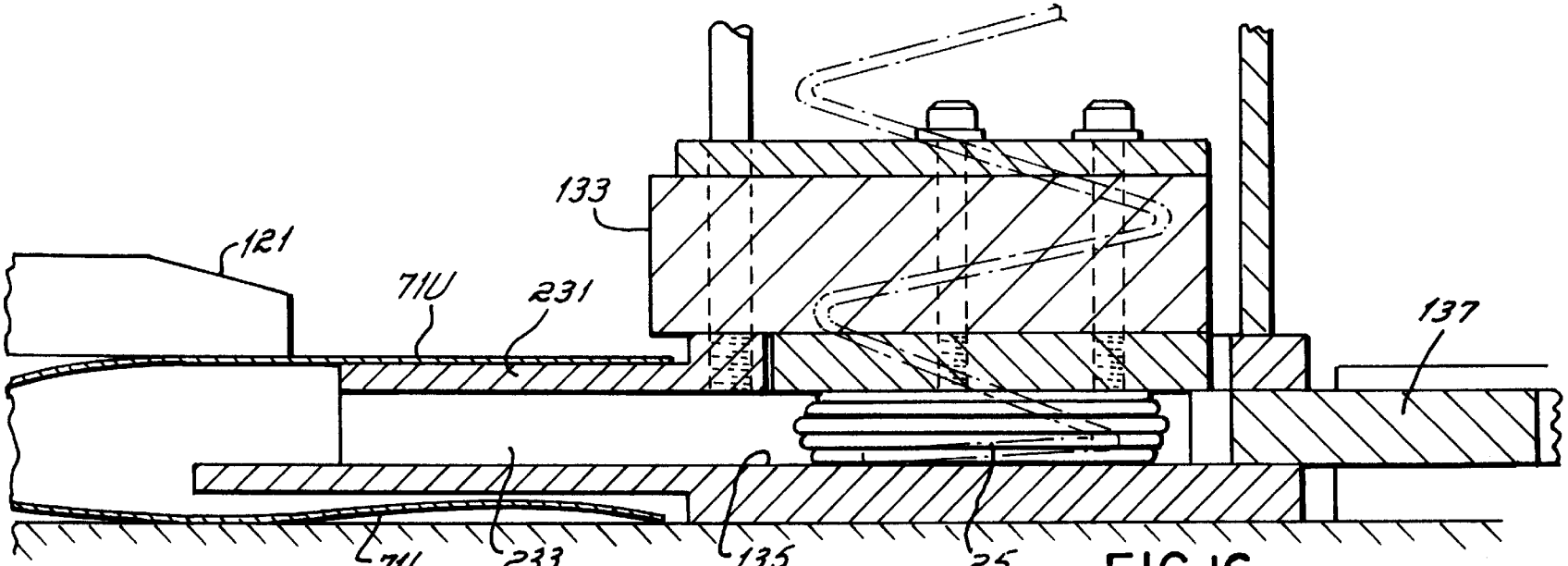
FIG. 16 is an enlarged view of the left portion of FIG. 15 showing the compression member compressing a coil spring prior to movement between the length of folded fabric.
Figure 17:
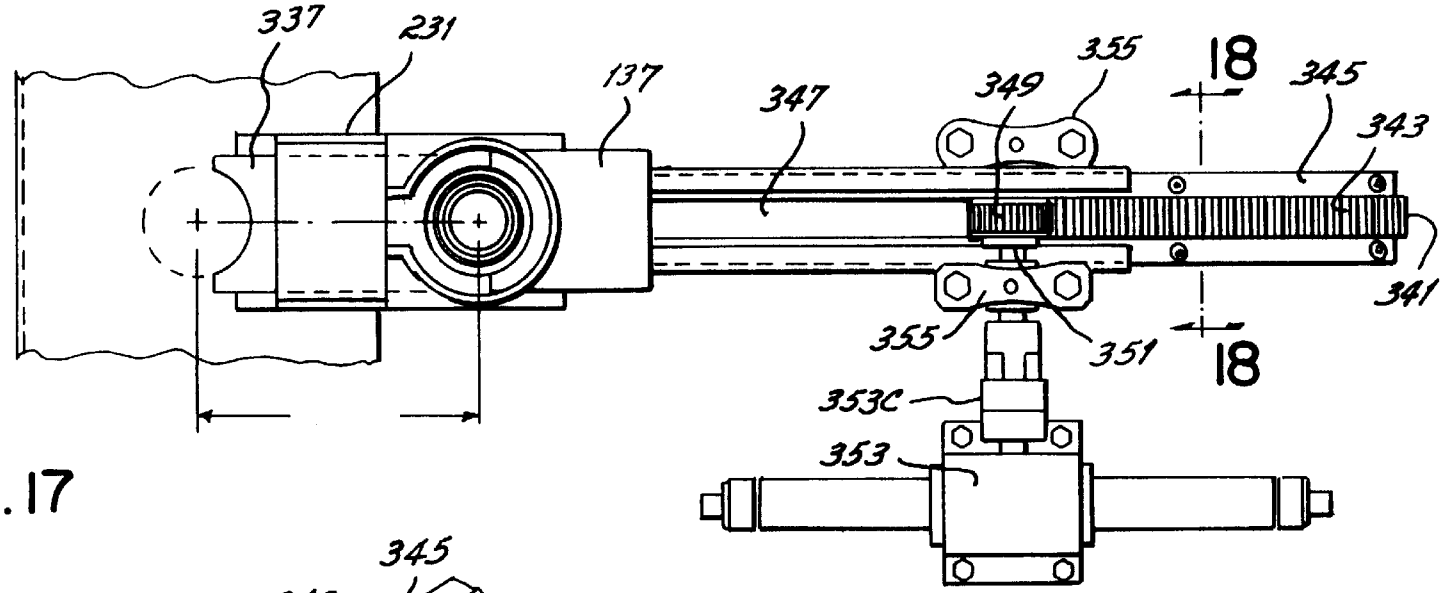
FIG. 17 is a top view of the mechanism for moving a compressed spring outward for insertion between the lower and upper layers of a folded length of fabric on the frame.
Figure 18:
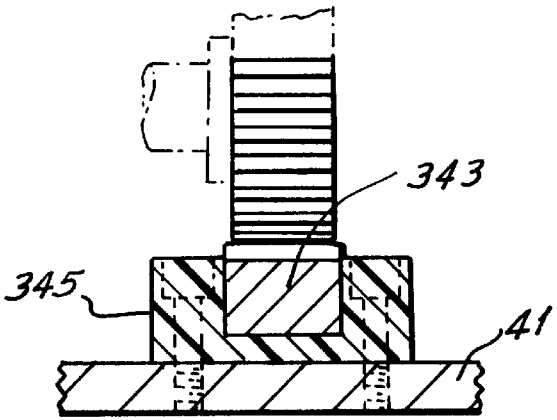
FIG. 18 is a cross-sectional view of FIG. 17 taken along the lines 18—18 thereof.
Figure 19:
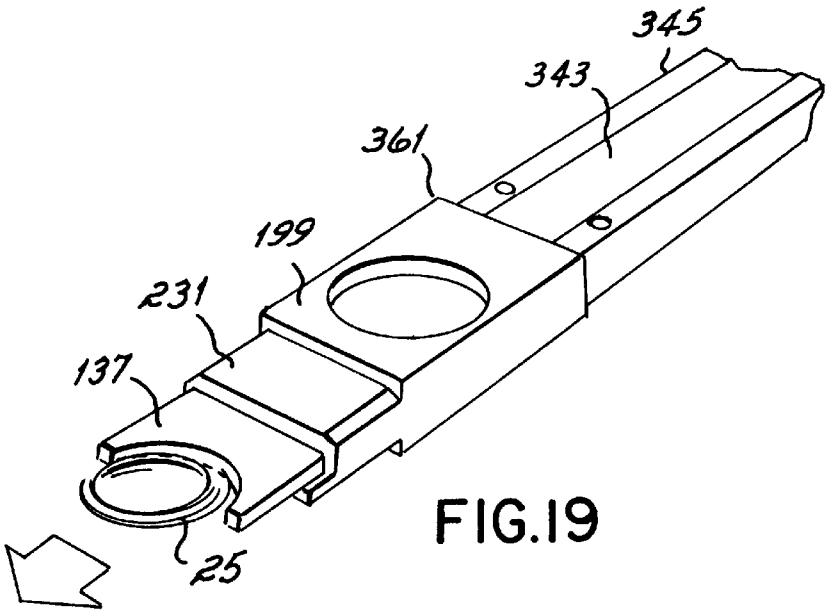
FIG. 19 is an isometric view of a portion of the coil spring inserting device.
Figure 21:
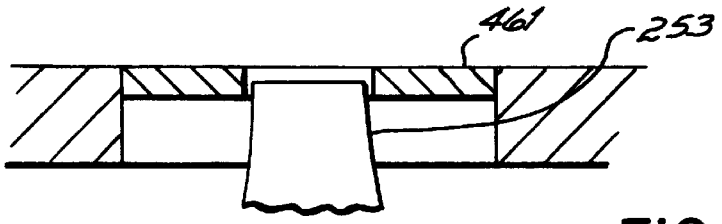
FIGS. 21–24 illustrate inserts for location in a frame aperture for receiving the upper edge of one of the ultrasonic welding horns.

As shown in FIGS. 9–11 and 15, 16, 17, and 19, a tubular member 231 having a opening rectangular in cross section 233 formed therethrough, is connected to the frame 41 in line with the pusher 137 such that a compressed coil spring 25 and pusher 137 move through the member 231 as the compressed coil spring is pushed between the layers 71L and 72U. As shown in FIG. 16, as the folded sheet 71A moves along the frame, the edges of the lower and upper layers 71L and 71U pass below and above the lower and upper walls 231L and 231U of member 231, such that the member 231 insures that there always will be an opening leading to the space between the sheet layers 71L and 71U to receive the coil springs 25. The member 231 thus prevents the edges 71LE and 71LU from blocking passage of the coil springs into the space between the layers 71L and 71U.

The plate 121 maintain the coil springs 25 in their compressed state as the folded sheet 71A moves downstream toward the bonding units 141 and 143.

Figure 12:
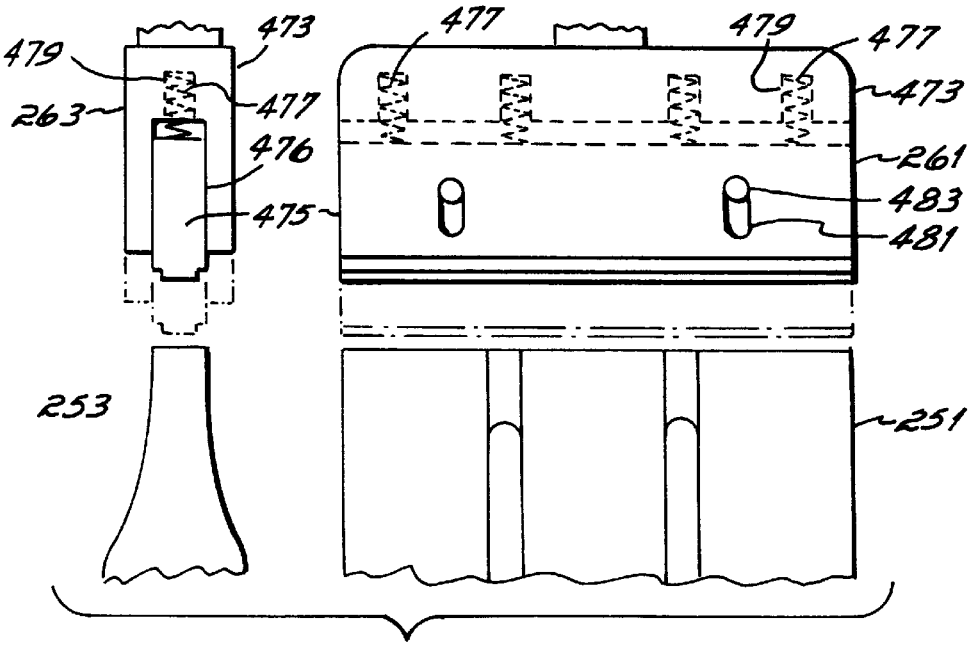
FIG. 12 illustrates two bonding units in non-bonding positions.
Figure 13:
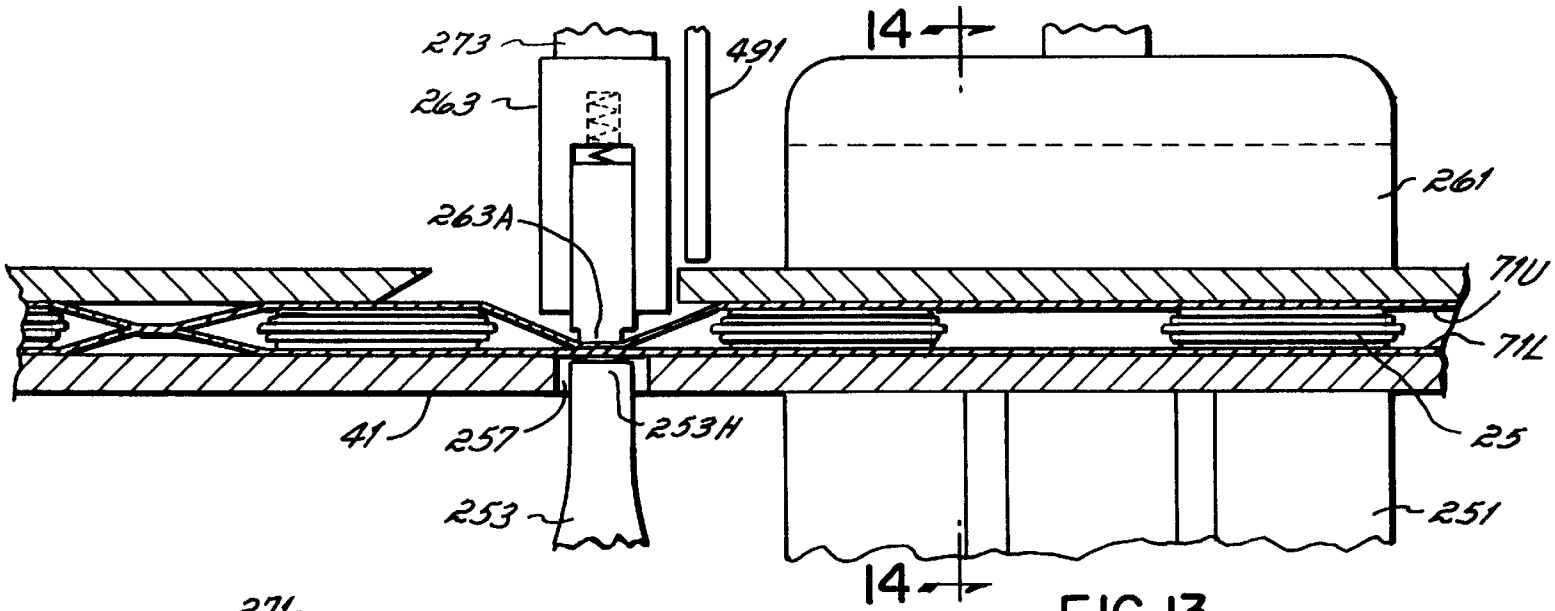
FIG. 13 is schematic cross section of a folded sheet of fabric as it passes to the bonding units.
Figure 14:
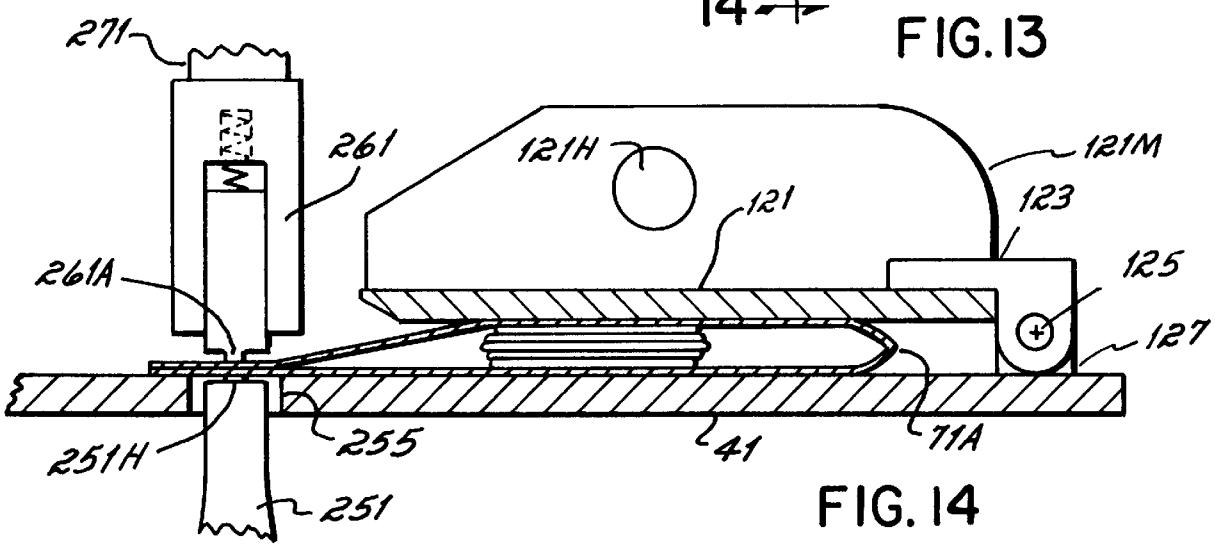
FIG. 14 is a cross section of FIG. 13 taken along the lines 14—14 thereof.
Figure 15:
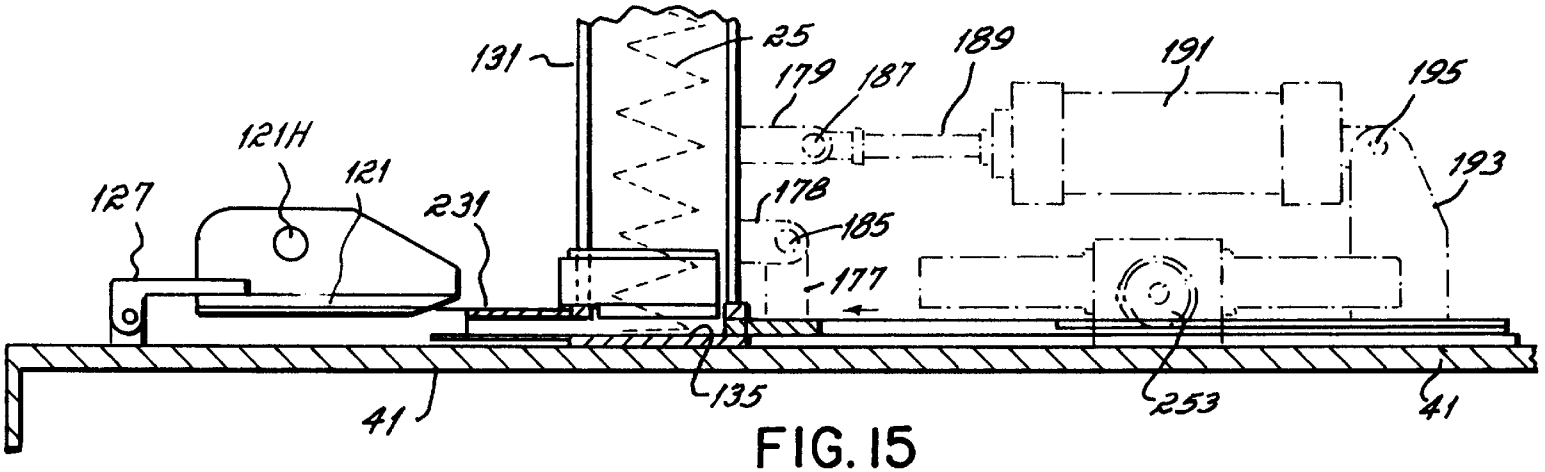
FIG. 15 is a cross section of the top of the frame similar to that of FIG. 3 showing more detail of the apparatus.

Referring to FIGS. 7, 13, 14, and 20, the bonding units 141 and 143 comprise two stationary ultrasonic bonding devices (horns) 251 and 253 located below the frame 41 with their heads 251H and 253H extending into apertures 255 and 257 formed through the frame 41 and two vertically movable upper anvils 261 and 263 which can be moved between upper non-bonding positions as shown in FIG. 12 and bonding positions as shown in FIGS. 13 and 14 wherein the anvil members 261A and 263A can engage or be located very close to the heads 251H and 253H respectively. The upper ends of the heads 251H and 253H are located slightly below the upper level of the frame to prevent damage to the heads During bonding, the anvil members 261A and 263A will push the layers 71U and 71L against the heads 251H and 253H.

The anvils 261 and 263 are connected to pistons 271 and 273 of pneumatic cylinders 275 and 277 respectively which move the members 261 and 263 downward for bonding purposes and upward for release purposes. The bonding unit 251 and 261 are located above the edges 71LE and 71UE of the folded sheet 71A are and spaced outward from the plate 121 for forming the edge bond 33BE. The bonding units 253 and 263 are located across the frame 41 and hence across the folded sheet 71A and are spaced downstream from the plate 121 for forming the transverse bonds 33BT.

As shown in FIG. 7, the lower supports 251LS and 253LS of the horns 251 and 253 are secured to the floor 41F of the frame 41 by bolts 251B and 253B.

As shown in FIG. 8, the cylinders 275 and 277 are supported by structure 275S and 277S connected to the frame 41 by bolts 275B and 277B.

The units 141 and 143 are operated together to form a pair of bonds 33BE and 33BT. The anvils 261 and 263 then are raised, the folded sheet 71A is moved downstream a given amount and the units 141 and 143 are operated to make another set of bonds 33BE and 33BT. The bonds 33E form a continuous bond at the edge of the sheet 71A and two sequential bonds 33BT form bonded seams on opposite sides of a coil spring across the sheet 71A.

When heat and pressure is applied by the ultrasonic devices 251 and 253 and anvils 261 and 263 to the layers of the folded sheet 71A, they bond together to form the pocket enclosing a coil spring 25.

The sheet with the pockets 33 and the coil springs 25 in a compressed state moves downstream under plates 151 and 153 and between rollers 155U and 155L.

The roller 155L is driven or rotated by a pneumatic rotary actuator 281 and a shaft 283 (see FIG. 8) which engages the sheet 71A against the roller 155U with the pockets and compressed springs and at spaced apart time periods pulls the sheet 71A to the left as shown in FIG. 8 a given distance equal to 4¼ inches in one embodiment. The rotary actuator 281 includes a one way clutch to rotate the roller 155L in one direction only. The shaft of the roller 155U is biased downward by springs 155S.

Referring to FIGS. 7 and 8 the unit 161 comprises a housing 161H which has open front and rear ends for allowing passage of the folded sheet 71A with its pocket coils. Located in the housing is a rotatable mechanism which is rotated by a pneumatic rotary actuator 311 and a shaft 312. The rotary actuator 312 includes a one way clutch to rotate the rotatable mechanism in one direction only.

Connected to the frame 41 is an electric motor 319 which rotates a shaft 321 located under the frame 41. Connected to the shaft 321 is an expander 323 which may comprise a paddle member or a vibrator located under the member 161 a distance sufficient to allow passage of the continuous folded sheet 71A with its coil springs 25 formed in the pockets 33. As the sheet 71A reaches the expander 323, the expander engages the bottom of the sheet 71A and cause the coil springs to assume their uncompressed state and turns the coils to the desired positions in the pocket as shown in FIG. 2. The rotatable mechanism in housing 161H at spaced apart time periods pulls and indexes the expanded coil springs in its pocket from the rollers 155U and 155L.

The rotary actuator 281 is operated at periodic intervals to allow the rollers 155U and 155L periodically to pull the continuous sheet 71A an amount equal to a given distance depending on the desired coil diameter. After each pulling operation while the sheet 71A is stationary, the bonding units 141 and 143 are operated to allow the bonds 33BE and 33BT to be formed.

After bonding, the anvils 261 and 263 move upward and the roller 155 is actuated to move the sheet the given distance referred to above.

Referring to FIGS. 8, 15, 17, and 18, the system for pushing a compressed coil 25 between the layers 71U and 71L of the folded sheet 71A comprises a rack 341 having teeth 343 supported for slidable movement in a trough 345. The pusher 137 is connected to one end of the rack 241 by a member 347 rectangular in cross section. A gear 349 rotated by a shaft 351, a coupling member 353C and a pneumatic rotary actuator 353 which can drive the rack 341 in opposite directions moves the pusher 137 out for pushing a coil spring 25 in place between the layers 71U and 71E of the folded sheet 71A and then back again to allow the next coil spring 25 to be placed on the support 135. The actuator 353 is controlled to allow the actuator 353 to rotate the shaft 351 and hence the gear 349 is opposite directions. The trough 345 is secured to the frame 41 by bolts 347.

A more detailed description of certain components of the invention now will be made.

The upper stationary coil spring guide 61 acts as a sizer. It controls the flow of the formed coil springs 25 and accords the gravitational free fall of the formed springs. For example, the coil spring is too big in diameter it will not pass through the guide 61.

The lower positioning coil spring guide 131 controls the coil spring positioning from 45 degrees to an upright position suitable for the entry of the spring compressor 133S through the front slot 175 of the guide 131. At the end of its fall in the guide 131, the coil spring 25 is prevented from reversing its direction by means of the bristles 221 of device 223 which positions the spring and eliminates any possibility of the spring interfering with the compressor shoe 133S.

Figure 10:
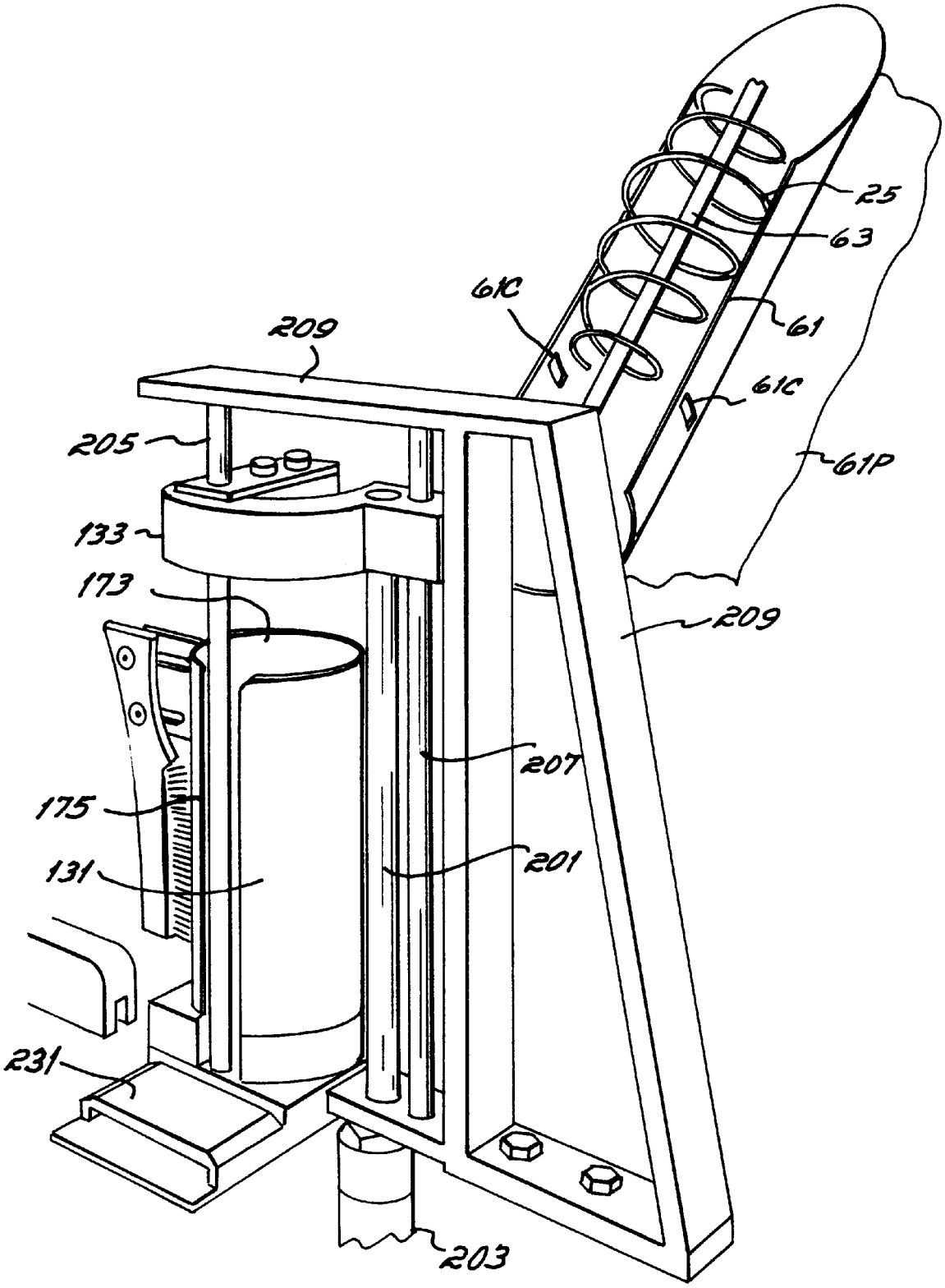

Both spring guides 61 and 131 also act as diameter controls. There may be attached to either spring guides 61 and 131, sensors 61C with maximum and minimum settings for deactivating the machine if the diameter of a coil spring does not fall within the maximum and minimum diameter settings. The sensors 61C shown are attached in apertures of the chute 61 as shown in FIG. 10. They may be a mechanism for generating a magnetic field or a light beam detector mechanism which opens a switch 601 as shown in FIG. 30B to deactivate the machine if the diameter of the coil spring is outside the maximum and minimum limits.

The bristle device 223 controls the landing of the gravitational fall of the springs so that the spring is in the exact position for the sole 133S of the compressor shoe to make contact with the springs.

In the 45 degree position of a spring on the surface 135, positioning and guide rod 205 prevents the spring from leaving the compressor and inserter opening 136.

The shape of the compressor 133 and the slot 175 in the front of the lower positioning spring guide 133 allows the guide 131 to return to the 45 degree position when the compressor 133 is at its lowest point without the compressor 133 having to return to its upper starting position. This places the guide 131 in a position ready to receive the next spring which increases the rate at which the machine can operate.

Only at the compressor's 133 lowest position will the inserter 137 be activated. As the compressor 133 reaches its lowest position it activates a switch 565 (See FIG. 30A) which activates the inserter 137. The inserter 137 is moved forward when the air rotary actuator 353 is activated. This then rotates the pinion or gear 349 to move the rack 341 attached to the inserter 137. The rack and pinion device 341, 349 insures a smooth and even force by the inserter. The rotary actuator 353 also works on a rack and pinion mechanism.

The upper edges of the ultrasonic horns 251 and 253 are positioned below the top surface of the frame 41 to prevent damage to the top surface of the horns 251 and 253. The horns 251 and 253 remain stationary in a protected environment to eliminate damage to the horns 251 and 253.

Figure 22:
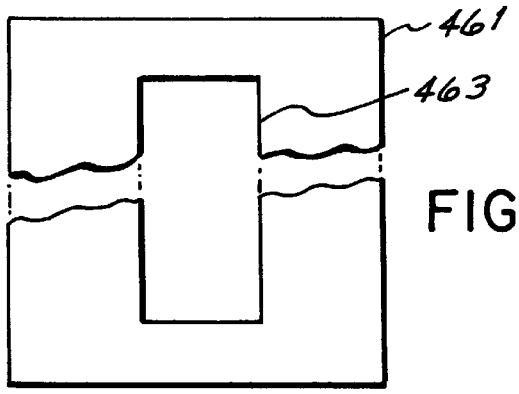
Figure 23:
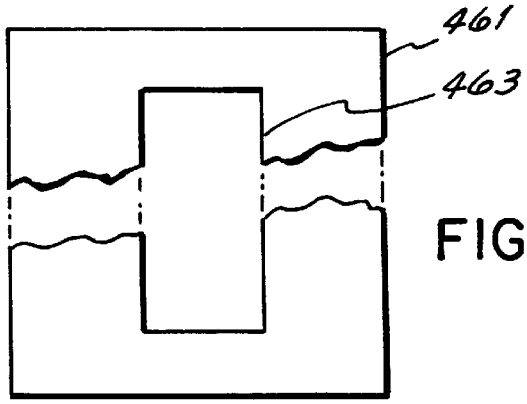
Figure 24:
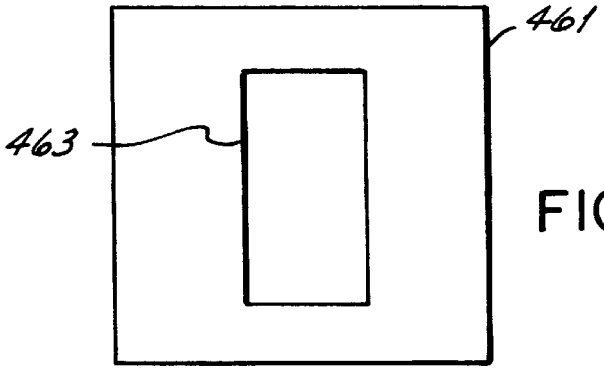
Figure 25:
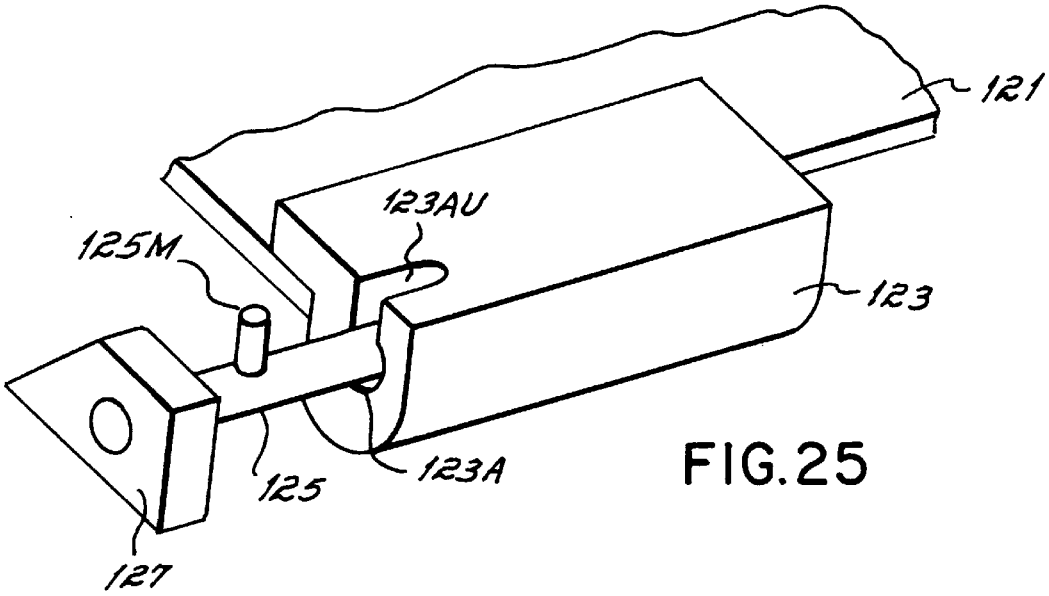
FIG. 25 is a partial view of the locking and pivot mechanism of the upper transparent plate coupled to the upper side of the frame.

Referring to FIGS. 21–24, a plate 461 having a slot 463 is removably located in the frame opening 257 for receiving the upper head 253H of the horn 253 as shown in FIG. 7. The plate 461 can have the slot 461 centered as shown in FIGS. 22 and 23 or located to the right or left of the center as shown in FIGS. 24 and 25. Screw holes 277H are formed in the frame 41 to the left and right of the anvil support 277S as shown in FIG. 8 and screw holes 253H are formed in the floor frame 41F to the left and right of the lower support base 253LS of the horn 253. This feature plus use of the different plates 461 of FIGS. 22–25 allows different pocket sizes to be formed for springs of different diameters. The rotary actuators 281 and 311 that index the folded sheet 71A and the turned and expanded coil springs out of the machine also can be adjusted for different diameter coil springs by the angle of adjustment of the controls at each end of the actuators. This controls the distance that the indexing devices pull the folded sheet 71A and the expanded coil out of the machine. In FIG. 8, the end controls for the actuator 311 are shown at 311C.

Referring to FIG. 12, the anvils 261 and 263 are identical and are spring loaded anvils. In this respect each anvil has an upper U-shaped portion 473 and a lower portion 475 slidably located in the opening 476. Springs 477 have their upper ends attached in apertures 479 of the upper portion 473 and their lower ends attached to the lower portions 475. Elongated apertures 481 are formed in the lower portions for receiving rods 483 coupled to the upper portions. The apertures 481 and rods 483 limit upward and downward movement of the lower portions 475 relative to the upper portions 473. This arrangement allows the lower portions of the anvils to be self aligning to insure proper alignment with the ultra sonic horns to provide cushioning of the anvils during sealing. This feature is not disclosed in FIG. 7 for purposes of clarity.

Referring to FIG. 8, the connecting member 123 and hence the transparent plate 121 and can slide to the left and right on the rod 125. Referring also to FIGS. 13, 14, and 25, the rod 125 is supported by brackets 127. The member 123 has an aperture 123A for receiving the rod 125. The aperture 123A has an upward extending portion 123AU on the left end for receiving a stud 125M connected to the rod 125 when the member 123 is moved to the left. In this position, the member 123 cannot pivot relative to the rod 125. In the left position, the left edge of the plate 121 next to the frame edge 51 is positioned under a lock member 491 connected to the support 273S of the piston 273. See FIG. 13. Thus the plate 121 is locked in place above the folded fabric 71A. In order to pivot the plate 121 out of the way for inspection or repair purposes, the plate 121 is moved to the right to move its edge from under the lock member 491 and to move the member away from the stud 123M to allow the plate 121 to be pivoted upward away from the frame edge 51.

Figure 26:
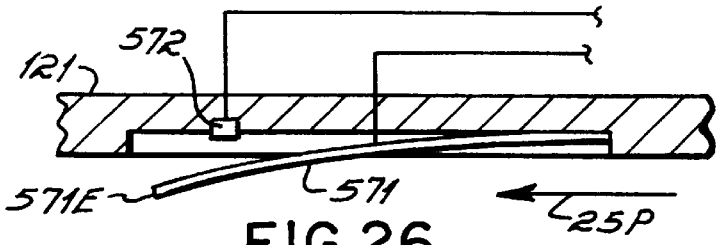
FIG. 26 illustrates a switch coupled to the lower side of the transparent plate of FIG. 25.

Referring to FIG. 26, the underside of the plate 121 has a spring switch 571 attached thereto such that the switch end 571E is urged downward to an open position. The position of the switch 571 is slightly downstream of the inserter 137 and the switch 571 is long enough such that it is always engages contact 572 if there are coil springs below the switch. The path of the flow of the compressed coil springs between the layers 71L and 71U of the folded material 71A is illustrated by the arrow 25P in FIG. 26. If there is a coil spring below the switch, the switch engages contact 572 and the machine keeps operating. The switch 571 is shown in FIG. 30B. If a coil spring is not inserted into between the layers of folded fabric, the switch does not engage the contact and the machine is shut down.

Figure 27:
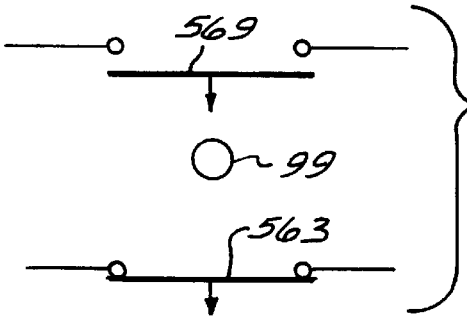
FIG. 27 illustrate sensors for controlling the floating fabric roller at the front end of the machine.

Referring to FIGS. 27 and 30, two switches 563 and 569 are located above and below the floating roller 99. Switch 563 normally is closed. Switch 569 normally is open.

If the tension of the fabric becomes too great as it is being fed on the frame 41, the roller 99 moves up to close switch 569 to shut the machine down.

If the tension of the fabric becomes too low as it is being fed on the frame 41, the roller 99 moves down to open the switch 563 to shut down the feed motor 111 until the tension increases.

Figure 28:
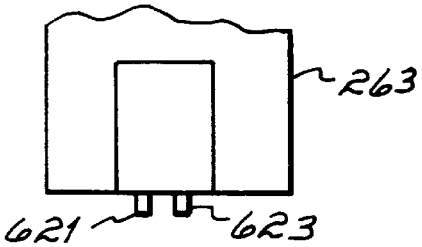
FIG. 28 illustrates the head of an anvil having dual compression members of one of the ultrasonic bonders for forming dual seals across the length of folded fabric to form the pockets for the coil springs as shown in FIG. 29.
Figure 29:
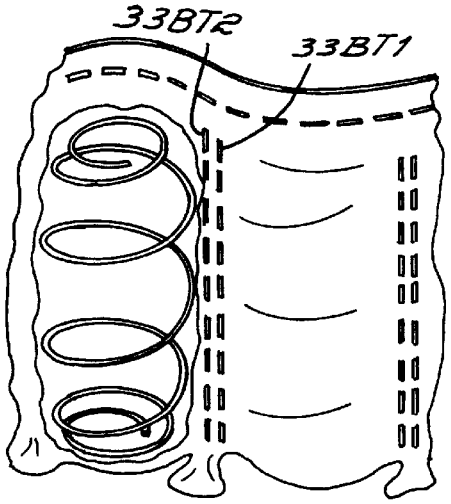

The lower head 263A of the anvil 261 is shaped to make an S shape transverse bond as shown at 33BT in FIG. 2. The lower head of the anvil 263 may have two spaced apart pressure members 621 and 623 as shown in FIG. 28 to make a dual transverse bond 33BT1 and 33BT2 as shown in FIG. 29.

Figure 30A:
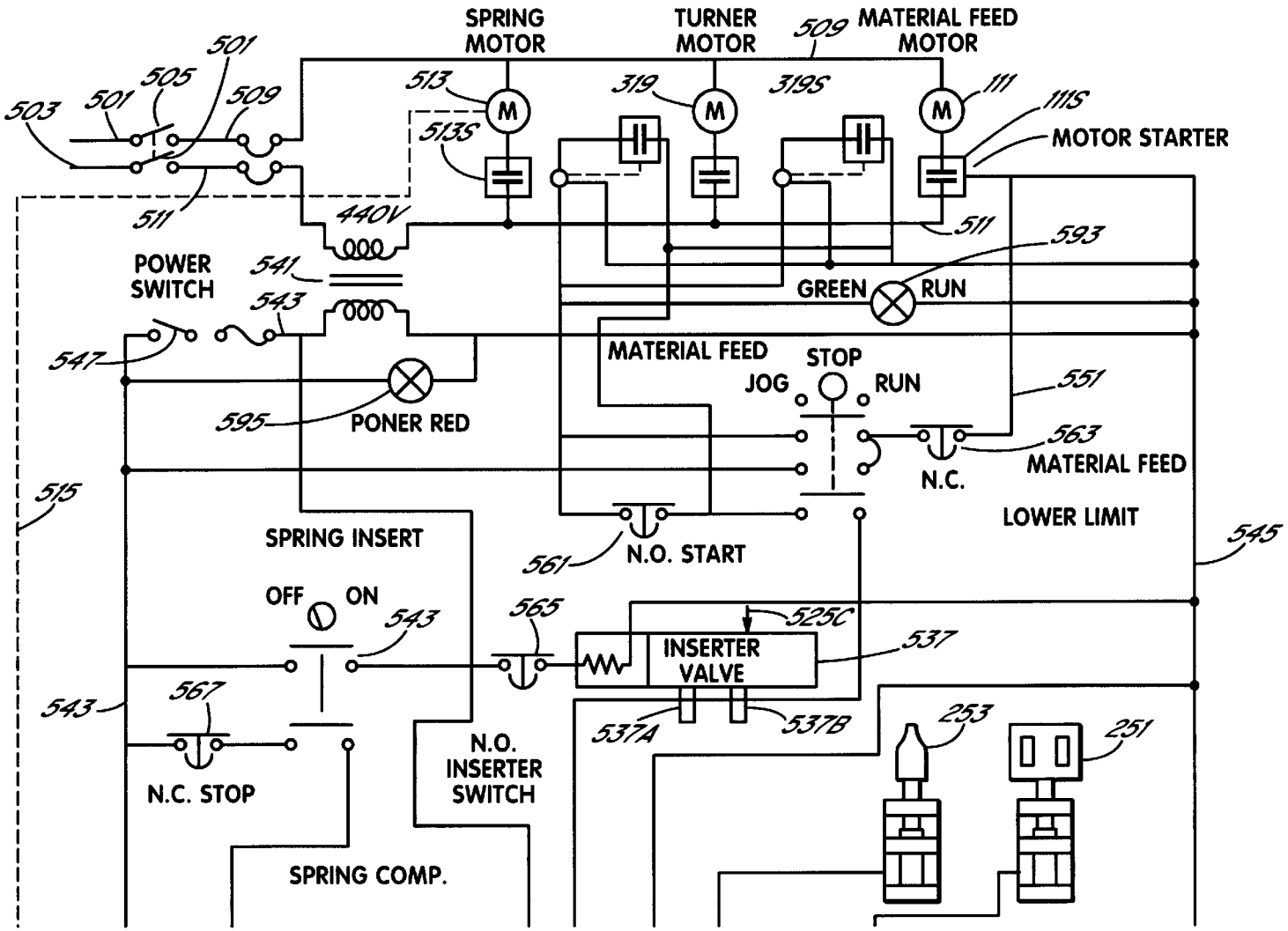
FIGS. 30A and 30B are a block diagram of the electrical and pneumatic control system of the invention. In viewing these FIGS. the lower edge of FIG. 30A should be placed adjacent to the upper edge of FIG. 30B.
Figure 30B:
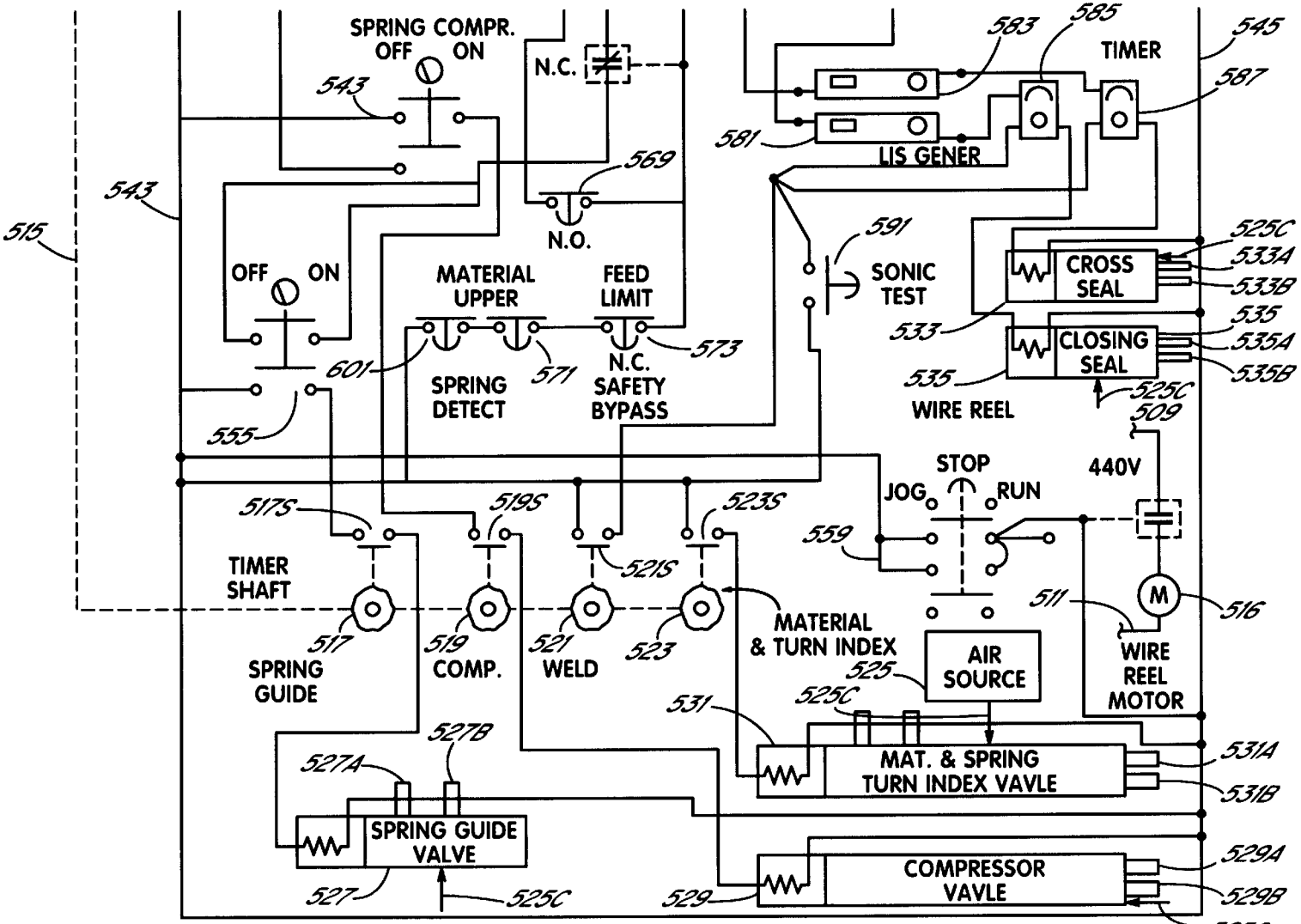

Referring now to FIGS. 30A and 30B there will be described the electrical and pneumatic system for controlling the apparatus of the invention. 440 volts AC is fed by way of leads 501 and 503 and switches 505 and 507 to leads 509 and 511 with a spring motor 513, the turner motor 319, and the material feed motor 111 coupled to the leads 509 and 511. Members 413S, 319S and 111S are motor starters. Also coupled to leads 509 and 511 is a wire reel motor 516 for operating the wire reel of the coil forming machine 21. The motor 516 is operated by 440 volts AC. Member 516S is a motor starter. Motor 513 is the motor of the spring forming machine 21. The motor 513 has a shaft 515 which drives four cams 517, 519, 521, and 523 for controlling the spring guide 131, the compressor 133, the ultra sonic welding units 141 and 143 and the roller 155L and material and turn indexer 161. Also provided is a source 525 of compressed air having compressed air conduits 525C coupled to electrically actuated valves 527, 529, 531, 533, 535, and 537. Valve 527 has two air conduits 527A and 527B coupled to pneumatic cylinder 191 for operating the cylinder to move the split cylinder 131. Valve 529 has two air conduits 529A and 529B coupled to the pneumatic cylinder 203 for operating the compressor 133. Valve 531 has two air conduits 531A and 531B coupled to the rotary actuator 281 and to the rotary actuator 311 for operating roller 155L and the indexing unit 161. Valve 533 has two air conduits 533A and 533B coupled to the pneumatic cylinder 275 for operating the anvil 261. Valve 535 has two air conduits 535A and 535B coupled to the pneumatic cylinder 277 for operating the anvil 263. Valve 537 has two air conduits 537A and 537B coupled to the rotary actuator 535 for operating the inserter 137.

The lead 511 is coupled to a step down transformer 541 for converting the 440 volts AC to 110 volts AC. The secondary of the transformer 541 is coupled to two leads 543 and 545. Lead 543 has a power switch 547. Switch 551 is a manual off-on spring inserter switch. Switch 553 is a manual off-on spring compressor switch. Switch 555 is a manual off-on spring guide (split cylinder) switch. Switch 557 is a manual switch, material jog, stop and feed run switch. Switch 559 is a manual wire reel jog, stop and run switch.

Switch 561 is a normally open start switch. Switch 563 is a normally closed material feed lower limit switch. Switch 565 is a normally open inserter switch. Switch 567 is a normally closed stop switch. Switch 569 is a normally open material feed upper limit switch. Switch 571 is a normally closed spring detect switch. Switch 573 is a normally closed safety by-pass switch. Switch 601 is a normally closed switch coupled to the sensors of the guide 61. Normally open switches 517S, 519S, 521S, and 523S are periodically closed by their cams 517, 519, 521, and 523 respectively when the cams are turned by the shaft 515.

The ultra sonic horns are shown at 251 and 253. Members 581 and 583 are current generators. Members 585 and 587 are timers that control the anvils 261 and 263 and the ultra sonic welders 251 and 253.

Switch 591 is a normally open manual sonic test switch for testing the devices 251, 261, and 253, 263. Members 593 and 595 are green and red lights respectively.

The operation of the system now will be described. Assume that switches 505 and 507 are closed; switches 551, 553, and 555 are in their on positions; switches 557, and 559 are in their run positions; switch 561 is open; switch 563 is closed, switch 567 is closed, switch 569 is open; switches 571, 573, and 601 are closed and switch 591 is open.

Assume further that the folded sheet 71A is stationary and the cam 517 has closed switch 517S to cause the valve 527 to actuate the cylinder 191 to move the split cylinder 131 with a coil spring 25 therein to the upright position. As the shaft 515 rotates, the cam 519 closes the switch 519S to actuate the valve 529 to cause the cylinder 203 to move the compressor 133 downward to compress the coil spring. In the downward position, the compressor 133 closes the switch 565 which actuates the valve 537 to cause the rotary actuator 353 to move the inserter 137 forward to push a compressed coils spring 25 in place between the layers 71U and 71L of the folded fabric. When the cam 519 allows switch 519 to open, the valve 529 causes the cylinder 203 to move the compressor 133 upward. When the compressor 133 moves upward, the switch 565 opens and the valve 537 causes the actuator 353 to move the inserter 137 rearward. The cam 521 has closed the switch 521S to actuate the timers 585 and 587 to actuate the valves 533 and 535 to cause the cylinders 275 and 277 to move the anvils 261 and 263 down and then to cause the welders 251 and 253 to form an edge bond and a transverse bond. When the switch 521S opens, the anvils 261 and 263 move upward and the bonders 261 and 263 terminate the bonding operation. The cam 523 then closes switch 523S to cause the valve 531 to actuate the rotary actuators 281 and 311 to move the folded material 71A downstream and to index the turned pocket coil spring out of the apparatus. The motor 319 continually turns to operate the expander and turner 323. While this is happening, the cam 517 has allowed switch 517S to open to cause the valve 527 to move the split cylinder to its inclined position to receive another coil spring. When the switch 523S opens, the valve 531 causes the actuators 281 and 311 to stop. The folded sheet 71A then is stopped in its movement and the cycle is repeated.

If the tension of the folded sheet 71A gets too low, the switch 563 is opened to stop the feed motor 111. If the tension of the folded sheet gets too high, the switch 569 is closed to stop the apparatus.

If a coil spring is not inserted in the folded sheet, the switch 571 opens to stop the machine.

In FIG. 7, two control panels 621 and 623 are shown to the lower right of the apparatus. Normally they will be located in the positions shown in FIG. 1.

What is claimed is:

1. An apparatus for receiving coil springs produced by a coil spring producing machine for producing a string of pocket coil springs, each coil spring of which is enclosed in a flexible pocket with each pocket being coupled to an adjacent pocket, comprising:

a frame having first and second ends and first and second edges, with said first edge being located next to the coil spring producing machine, material moving means for moving a folded length of flexible material from said first end toward said second end of said frame with said folded length of flexible material having a lower layer and an upper layer, a folded edge near said second edge of said frame and adjacent edges located next to said first edge of said frame, an upper inclined guide for receiving coil springs produced by the coil spring producing machine, a lower movable guide having a surrounding wall extending between open upper and lower ends with a gap formed through said wall between said open upper and lower ends, support means located next to said first edge of said frame, means for moving said lower movable guide between first and second positions such that at said first position, said upper open end of said movable guide is in line with said upper inclined guide for receiving a coil spring and in said second position, said upper open end of said movable guide is spaced away from said upper inclined guide to allow a received coil spring to be located on said support means by way of said lower open end, compressing means for insertion into said movable guide by way of said gap for compressing a coil spring against said support means, inserting means for moving a compressed coil spring from said support means to a position between said lower and upper layers of said folded length of flexible material by way of said adjacent edges, bonding means located between said second end of said frame and said compressing and inserting means for bonding said lower and upper layers together along said adjacent edges to form a bonded edge and two spaced apart transverse bonded seams transverse to said bonded edge and on opposite sides of a compressed coil to form a flexible pocket containing a coil spring.

2. The apparatus of claim 1, comprising:

roll support means for supporting a roll of said flexible material, folding means located between said roll support means and said first end of said frame for receiving flexible material from the roll supported by said roll support means and folding said flexible material to form said folded length of flexible material, front drive means for moving said folded flexible material on said frame and hence flexible material from said roll, sensing means for sensing the tension of said folded flexible material for shutting down said front drive means if the tension becomes too low and for shutting down said apparatus if the tension becomes too high.

3. The apparatus of claim 2, wherein:

said roll support means comprises a spindle having a given axis for supporting a roll of said flexible material, first and second rods supported below the level of said first end of said frame at an angle of about 90° relative to each other, third and fourth rods supported below the level of said first end of said frame generally parallel to each other, transverse to said spindle, and about 45° relative to said first and second rods such that material from said roll extends under, around, and over said first and second rods and, between said third and fourth rods to form said folded length of flexible material which extends upward partially around an edge of said first end of said frame and onto said frame.

4. The apparatus of claim 2, wherein:

said bonding means comprises a first bonding means for bonding said adjacent edges together to form said bonded edge and a second bonding means for forming said transverse bonded seams, and control means for causing said material moving means to intermittently move said length of folded material along said frame past said compressing and inserting means and past said first and second bonding means whereby said folded length of material is stopped at given intervals to allow a compressed coil spring to be inserted between said upper and lower layers of said length of folded material and to allow said bonded edge and said transverse bonded seams to be formed, each of said bonding means comprises a stationary ultrasonic bonding means and a movable anvil located above said said stationary ultrasonic bonding means for movement between an upward position away from said stationary ultrasonic bonding means and a downward position toward said stationary ultrasonic bonding means to urge said folded length of flexible material against said stationary ultrasonic bonding means for bonding purposes, said anvil of each of said bonding means comprises an upper portion and a lower portion with springs coupled between said upper and lower portions such that said lower portion normally is urged away from said upper portion.

5. The apparatus of claim 1, wherein:

said compressing means comprises, a compression member supported to move into and out of said movable guide by way of said gap, and means for moving said compression member downward when in said movable guide for compressing a coil spring therein and upward after the coil spring has been compressed.

6. The apparatus of claim 5, wherein:

said inserting means comprises, an inserting member for engaging a compressed coil spring, means for moving said inserting member while engaging a compressed coil spring, from said support means outward to insert the compressed coil spring between said upper and lower layers of said length of folded material and for moving said inserting member back to said support means, and a stationary member having an opening formed therethrough between opposite first and second ends for receiving said inserting member and a compressed coil spring for passage therethrough, said stationary member being located such that said adjacent edges of said lower and upper layers of said folded length of flexible material pass below and above at least a portion of said stationary member.

7. The apparatus of claim 6, wherein:

said bonding means comprises a first bonding means for bonding said adjacent edges together to form said bonded edge and a second bonding means for forming said transverse bonded seams, and control means for causing said material moving means to intermittently move said length of folded material along said frame past said compressing and inserting means and past said first and second bonding means whereby said folded length of material is stopped at given intervals to allow a compressed coil spring to be inserted between said upper and lower layers of said length of folded material and to allow said bonded edge and said transverse bonded seams to be formed, each of said bonding means comprises a stationary ultrasonic bonding means and a movable anvil located above said said stationary ultrasonic bonding means for movement between an upward position away from said stationary ultrasonic bonding means and a downward position toward said stationary ultrasonic bonding means to urge said folded length of flexible material against said stationary ultrasonic bonding means for bonding purposes, said anvil of each of said bonding means comprises an upper portion and a lower portion with springs coupled between said upper and lower portions such that said lower portion normally is urged away from said upper portion.

8. The apparatus of claim 7, wherein:

said material moving means, comprises a drive means located near said second end for moving said length of folded material along said frame, control means for causing said drive means to intermittently move said length of folded material along said frame, rotatable means downstream of said drive means for engaging said length of folded material with said coil springs formed in pockets to move said length of folded flexible from said drive means.

9. The apparatus of claim 6, wherein:

said material moving means, comprises a drive means located near said second end for moving said length of folded material along said frame, control means for causing said drive means to intermittently move said length of folded material along said frame, rotatable means downstream of said drive means for engaging said length of folded material with said coil springs formed in pockets to move said length of folded flexible from said drive means.

10. The apparatus of claim 5, wherein:

said bonding means comprises a first bonding means for bonding said adjacent edges together to form said bonded edge and a second bonding means for forming said transverse bonded seams, and control means for causing said material moving means to intermittently move said length of folded material along said frame past said compressing and inserting means and past said first and second bonding means whereby said folded length of material is stopped at given intervals to allow a compressed coil spring to be inserted between said upper and lower layers of said length of folded material and to allow said bonded edge and said transverse bonded seams to be formed, each of said bonding means comprises a stationary ultrasonic bonding means and a movable anvil located above said stationary ultrasonic bonding means for movement between an upward position away from said stationary ultrasonic bonding means and a downward position toward said stationary ultrasonic bonding means to urge said folded length of flexible material against said stationary ultrasonic bonding means for bonding purposes, said anvil of each of said bonding means comprises an upper portion and a lower portion with springs coupled between said upper and lower portions such that said lower portion normally is urged away from said upper portion.

11. The apparatus of claim 5, wherein:

said material moving means, comprises a drive means located near said second end for moving said length of folded material along said frame, control means for causing said drive means to intermittently move said length of folded material along said frame, rotatable means downstream of said drive means for engaging said length of folded material with said coil springs formed in pockets to move said length of folded flexible from said drive means.

12. The apparatus of claim 1, wherein:

said inserting means comprises, an inserting member for engaging a compressed coil spring, and means for moving said inserting member while engaging a compressed coil spring, from said support means outward to insert a compressed coil spring between said upper and lower layers of said length of folded material and for moving said inserting member back to said support means.

13. The apparatus of claim 12, comprising:

a stationary member having an opening formed therethrough between opposite first and second ends for receiving said inserting member for passage therethrough, said stationary member being located such that said adjacent edges of said lower and upper layers of said folded length of flexible material pass below and above at least a portion of said stationary member.

14. The apparatus of claim 12, comprising:

a stationary member having an opening formed therethrough between opposite first and second ends for receiving said inserting member and a compressed coil spring for passage therethrough, said stationary member being located such that said adjacent edges of said lower and upper layers of said folded length of flexible material pass below and above at least a portion of said stationary member, said bonding means comprises a first bonding means for bonding said adjacent edges together to form said bonded edge and a second bonding means for forming said transverse bonded seams, and control means for causing said material moving means to intermittently move said length of folded material along said frame past said compressing and inserting means and past said first and second bonding means whereby said folded length of material is stopped at given intervals to allow a compressed coil spring to be inserted between said upper and lower layers of said length of folded material and to allow said bonded edge and said transverse bonded seams to be formed, each of said bonding means comprises a stationary ultrasonic bonding means and a movable anvil located above said stationary ultrasonic bonding means for movement between an upward position away from said stationary ultrasonic bonding means and a downward position toward said stationary ultrasonic bonding means to urge said folded length of flexible material against said stationary ultrasonic bonding means for bonding purposes, said anvil of each of said bonding means comprises an upper portion and a lower portion with springs coupled between said upper and lower portions such that said lower portion normally is urged away from said upper portion.

15. The apparatus of claim 12, comprising:

a stationary member having an opening formed therethrough between opposite first and second ends for receiving said inserting member and a compressed coil spring for passage therethrough, said stationary member being located such that said adjacent edges of said lower and upper layers of said folded length of flexible material pass below and above at least a portion of said stationary member, said material moving means, comprises a drive means located near said second end for moving said length of folded material along said frame, control means for causing said drive means to intermittently move said length of folded material along said frame, rotatable means downstream of said drive means for engaging said length of folded material with said coil springs formed in pockets to move said length of folded flexible from said drive means.

16. The apparatus of claim 1, wherein:

said bonding means comprises a stationary ultrasonic bonding means and a movable anvil located above said stationary ultrasonic bonding means for movement between an upward position away from said stationary ultrasonic bonding means and a downward position toward said stationary ultrasonic bonding means to engage said folded length of flexible material against said stationary ultrasonic bonding means for bonding purposes.

17. The apparatus of claim 1, wherein:

said bonding means comprises a first bonding means for bonding said adjacent edges together to form said bonded edge and a second bonding means for forming said transverse bonded seams, and control means for causing said material moving means to intermittently move said length of folded material along said frame past said compressing and inserting means and past said first and second bonding means whereby said folded length of material is stopped at given intervals to allow a compressed coil spring to be inserted between said upper and lower layers of said length of folded material and to allow said bonded edge and said transverse bonded seams to be formed.

18. The apparatus of claim 17, wherein:

each of said bonding means comprises a stationary ultrasonic bonding means and a movable anvil located above said stationary ultrasonic bonding means for movement between an upward position away from said stationary ultrasonic bonding means and a downward position toward said stationary ultrasonic bonding means to engage said folded length of flexible material against said stationary ultrasonic bonding means for bonding purposes, said anvil of each of said bonding means comprises an upper portion and a lower portion with springs coupled between said upper and lower portions such that said lower portion normally is urged away from said upper portion.

19. The apparatus of claim 1, wherein:

said material moving means, comprises a drive means located near said second end for moving said length of folded material along said frame, control means for causing said drive means to intermittently move said length of folded material along said frame, rotatable means downstream of said drive means for engaging said length of folded material with said coil springs formed in pockets to move said length of folded flexible from said drive means.

20. The apparatus of claim 1, comprising:

means for moving said compressing means between upper and lower positions for compressing a coil spring against said support means and for removing said compressing means from said lower movable guide, said compressing means and said gap have dimensions such that said compressing means and said lower movable guide may move relative to each other while said compressing means extends into said lower movable guide by way of said gap, said lower movable guide is movable along a given path between said first position which is an inclined position and said second position which is an upright position, said gap is located such that when said lower movable guide moves from said second position toward said first position said gap faces in a direction opposite to the direction of movement of said lower movable guide whereby said lower movable guide may move from said second position toward said first position while said compressing means is at its said lower position in said lower movable guide.

21. The apparatus of claim 20, comprising:

an upright elongated guide member located at a position close to said gap to prevent a coil from moving away from said support means when received in said lower movable guide, when said lower movable guide is in said first position, said compressing means being movably coupled to said elongated guide member for guiding said compressing means when it is moved between said upper and lower positions.

22. The apparatus of claim 21, comprising:

bristle means located in said lower movable guide for engaging a coil spring as it moves downward in said lower movable guide for minimizing reverse movement of a coil spring due to spring action when it moves downward and engages said support means.

23. The apparatus of claim 20, comprising:

bristle means located in said lower movable guide for engaging a coil spring as it moves downward in said lower movable guide for minimizing reverse movement of a coil spring due to spring action when it moves downward and engages said support means.

24. An apparatus for receiving coil springs produced by a coil spring producing machine, each coil spring of which is enclosed in a flexible pocket with each pocket being coupled to an adjacent pocket, comprising:

a frame having first and second ends and first and second edges, with said first edge being located next to the coil spring producing machine, material moving means for moving a folded length of flexible material from said first end toward said second end of said frame with said folded length of flexible material having a lower layer and an upper layer, a folded edge near said second edge of said frame and adjacent edges located next to said first edge of said frame, an upper inclined upper stationary coil spring guide for receiving coil springs produced by the coil spring producing machine, a movable guide having a surrounding wall extending between open upper and lower ends with a gap formed through said wall between said open upper and lower ends, support means having a compressing means opening and an inserting means opening located next to said first edge of said frame, means for moving said movable guide between first and second positions such that at said first position, said upper open end of said movable guide is in line with said inclined guide for receiving a coil spring and in said second position, said upper open end of said movable guide is spaced away from said upper inclined guide to allow a received coil spring to located on said support means, compressing means movable between upper and lower positions for insertion into said movable guide by way of said gap for compressing the coil spring against said support means, sensor means coupled to at least one of said guides for use for deactivating at least said machine if the diameter of a coil spring falls outside of maximum and minimum settings, bristle means located in said movable guide for positioning the coil spring and which minimizes the possibility of the coil spring interfering with said compression means, inserting means movable between an inserting position and a return position, said inserting means when moved to said inserting position moves a compressed coil spring from said support means to a position between said lower and upper layers of said folded length of flexible material by way of said adjacent edges, a rack, coupled to said inserting means, and a pinion for moving said rack and hence said inserting means between said inserting and return positions for obtaining a smooth and even force on said inserting means, a rotary actuator for rotating said pinion for moving said inserting means between said inserting and return positions, a positioning and guide rod for preventing a coil spring when in an inclined position from leaving said support means and for guiding said compressing means, switch means actuated by said compressing means when said compressing means is at its lower position for actuating said inserting means for moving a compressed coil spring from said support means to a position between said lower and upper layers of said folded length of flexible material, said compressing means having a shape and said gap formed in said movable guide being such as to allow said movable guide to move toward said inclined position at the point when said compressing means is at its lower position, and bonding means located between said second end of said frame and said compressing and inserting means for bonding said lower and upper layers together along said adjacent edges to form a bonded edge and two spaced apart transverse bonded seams transverse to said bonded edge and on opposite sides of a compressed coil to form a flexible pocket containing a coil spring, said bonding means comprises a first bonding means for bonding said adjacent edges together to form said bonded edge and a second bonding means for forming said transverse bonded seams, each of said bonding means comprises a stationary ultrasonic bonding means located slightly below the top surface of said frame to prevent damage to said ultrasonic bonding means and a movable anvil located above said frame for movement between an upward position away from said stationary ultrasonic bonding means and a downward position toward said stationary ultrasonic bonding means to urge said folded length of flexible material against said stationary ultrasonic bonding means for material bonding purposes.

25. An apparatus for receiving coil springs produced by a coil spring producing machine for producing a string of pocket coil springs, each coil spring of which is enclosed in a flexible pocket with each pocket being coupled to an adjacent pocket, wherein the coil spring producing machine is of the type having an upper guide for discharging coil springs, said apparatus comprising:

a frame having first and second ends and first and second edges, with said first edge to be located next to the coil spring producing machine, material moving means for moving a folded length of flexible material from said first end toward said second end of said frame with said folded length of flexible material having a lower layer and an upper layer, a folded edge near said second edge of said frame and adjacent edges located next to said first edge of said frame, a lower movable guide having a surrounding wall extending between open upper and lower ends with a gap formed through said wall between said open upper and lower ends, support means located next to said first edge of said frame, means for moving said lower movable guide between first and second positions such that at said first position, said upper open end of said movable guide is in line with the upper guide for receiving a coil spring and in said second position, said upper open end of said movable guide is spaced away from the upper guide to allow a received coil spring to be located on said support means by way of said lower open end, compressing means for insertion into said lower movable guide by way of said gap for compressing a coil spring against said support means, inserting means for moving a compressed coil spring from said support means to a position between said lower and upper layers of the folded length of flexible material by way of said adjacent edges, and bonding means for bonding the lower and upper layers of the folded length of flexible material together at positions to form a flexible pocket containing a coil spring.

26. The apparatus of claim 25, wherein:

said compressing means comprises, a compression member supported to move into and out of said movable guide by way of said gap, and means for moving said compression member downward when in said movable guide for compressing a coil spring therein and upward after the coil spring has been compressed.

27. The apparatus of claim 26, wherein:

said bonding means comprises a stationary ultrasonic bonding means and a movable anvil located above said stationary ultrasonic bonding means for movement between an upward position away from said stationary ultrasonic bonding means and to a downward position toward said stationary ultrasonic bonding means to engage the folded length of flexible material against said stationary ultrasonic bonding means for bonding purposes.

28. The apparatus of claim 25, wherein:

said bonding means compresses a stationary ultrasonic bonding means, and a movable anvil located above said stationary ultrasonic bonding means for movement between an upward position away from said stationary ultrasonic bonding means and to a downward position toward said stationary ultrasonic bonding means to engage the folded length of flexible material against said stationary ultrasonic bonding means for bonding purposes.

29. The apparatus of claim 28, comprising:

means for moving said compressing means between upper and lower positions for compressing a spring against said support means and for removing said compressing means from said lower movable guide, said compressing means and said gap have dimensions such that said compressing means and said lower movable guide may move relative to each other while said compressing means extends into said lower movable guide by way of said gap, said lower movable guide is movable along a given path between said first position which is an inclined position and said second position which is an upright position, said gap is located such that when said lower movable guide moves from said second position toward said first position said gap faces in a direction opposite to the direction of movement of said lower movable guide whereby said lower movable guide may move from said second position toward said first position while said compressing means is at its said lower position in said lower movable guide.

30. The apparatus of claim 29, comprising:

an elongated guide member located in a position close to said gap to prevent a coil from moving away from said support means when received in said lower movable guide, when said lower movable guide is in said first position, said compressing means being movably coupled to said elongated guide member for guiding said compressing means when it is moved between said upper and lower positions.

31. The apparatus of claim 30, comprising:

bristle means located in said lower movable guide for engaging a coil spring as it moves downward in said lower movable guide for minimizing reverse movement of a coil spring due to spring action when it moves downward and engages said support means.

32. The apparatus of claim 25, comprising:

means for moving said compressing means between upper and lower positions for compressing a coil spring against said support means and for removing said compressing means from said lower movable guide, said compressing means and said gap have dimensions such that said compressing means and said lower movable guide may move relative to each other while said compressing means extends into said lower movable guide by way of said gap, said lower movable guide is movable along a given path between said first position which is an inclined position and said second position which is an upright position, said gap is located such that when said lower movable guide moves from said second position toward said first position, said gap faces in a direction opposite to the direction of movement of said lower movable guide whereby said lower movable guide may move from said second position toward said first position while said compressing means is at its said lower position in said lower movable guide.

33. The apparatus of claim 32, comprising:

an upright elongated guide member located at a position close to said gap to prevent a coil from moving away from said support means when received in said lower movable guide, when said lower movable guide is in said first position, said compressing means being movably coupled to said elongated guide member for guiding said compressing means when it is moved between said upper and lower positions.

34. The apparatus of claim 33, comprising:

bristle means located in said lower movable guide for engaging a coil spring as it moves downward in said lower movable guide for minimizing reverse movement of a coil spring due to spring action when it moves downward and engages said support means.

* * * * *